US010442649B2

(12) United States Patent
Mellin

(10) Patent No.: US 10,442,649 B2
(45) **Date of Patent: *Oct. 15, 2019**

(54) SURFACE WINDER FOR PRODUCING LOGS OF CONVOLUTELY WOUND WEB MATERIALS

(71) Applicant: The Procter & Gamble Company, Cincinnati, OH (US)

(72) Inventor: Gustav André Mellin, Amberley Village, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 237 days.

This patent is subject to a terminal disclaimer.

(21) Appl. No.: 15/438,010

(22) Filed: Feb. 21, 2017

(65) Prior Publication Data

US 2017/0253448 A1 Sep. 7, 2017

Related U.S. Application Data

(60) Provisional application No. 62/303,481, filed on Mar. 4, 2016.

(51) Int. Cl.
*B65H 19/22* (2006.01)
*A47K 10/16* (2006.01)
(Continued)

(52) U.S. Cl.
CPC ..... *B65H 19/2269* (2013.01); *A47K 10/16* (2013.01); *B65H 18/14* (2013.01); *B65H 19/283* (2013.01)

(58) Field of Classification Search
CPC .. B65H 19/305; B65H 19/2269; B65H 23/24; B65H 23/26; B65H 20/14
See application file for complete search history.

(56) References Cited

U.S. PATENT DOCUMENTS 1,421,730 A 7/1922 Scusa
1,628,322 A 5/1927 Nicholas
(Continued)

FOREIGN PATENT DOCUMENTS

CN 2425067 Y 3/2001
CN 2575068 Y 9/2003
(Continued)

OTHER PUBLICATIONS

U.S. Appl. No. 15/438,061, filed Feb. 21, 2017, Mellin, et al.
(Continued)

*Primary Examiner* — William A. Rivera
(74) *Attorney, Agent, or Firm* — Andrew J. Mueller

(57) ABSTRACT

A surface winder for winding a web material around a core to obtain a log is disclosed. The surface winder provides a core inserter for inserting a core into an introductory portion of a winding cradle defined by an upper winding roller, a concave cradle, a lower winding roller, and a third oscillating roller. The concave cradle has a leading edge device having a surface with at least one channel disposed therein. The at least one channel has a single entry point and a single exit point and extending from a position external to the leading edge device and a first location disposed upon the surface capable of receiving a fluid from the at least one channel. The fluid is fluidically displaced onto the core from the at least one channel when the core is in contacting engagement with the first location disposed upon the surface.

20 Claims, 22 Drawing Sheets

(51) Int. Cl.
*B65H 18/14* (2006.01)
*B65H 19/28* (2006.01)

(56) References Cited

U.S. PATENT DOCUMENTS 1,870,225 A 8/1932 Berry
1,934,913 A 11/1933 Crisp
2,318,056 A 5/1943 Christman
2,493,590 A 1/1950 Mueller et al.
2,812,910 A 11/1957 Egan
2,877,959 A 3/1959 Aaron et al.
2,913,098 A 11/1959 Zellinsky et al.
3,258,136 A 6/1966 Leonard et al.
3,290,861 A 12/1966 Prager
3,345,010 A 10/1967 Francis
3,494,566 A 2/1970 Pawelczyk
3,498,557 A 3/1970 Ball
3,516,620 A 6/1970 Lenten
3,539,127 A 11/1970 Grawey
3,610,545 A 10/1971 Reifenhauser et al.
3,630,462 A 12/1971 Nordgren et al.
3,680,804 A 8/1972 Aaron et al.
3,733,035 A 5/1973 Schott
3,791,602 A 2/1974 Isakson
3,869,046 A 3/1975 Gerhart
3,908,923 A 9/1975 Salgo
4,223,851 A 9/1980 Lewallyn
4,299,358 A 11/1981 Dropczynski et al.
4,327,877 A 5/1982 Perini
4,370,193 A 1/1983 Knauthe
4,408,727 A 10/1983 Dropczynski
4,422,588 A 12/1983 Nowisch
4,428,543 A 1/1984 Kuhn
4,485,979 A 12/1984 Dropczynski
4,487,377 A 12/1984 Perini
4,500,044 A 2/1985 Schnell
4,516,735 A 5/1985 Snygg
4,541,583 A 9/1985 Forman et al.
4,583,698 A 4/1986 Nistri et al.
4,609,162 A 9/1986 Kataoka
4,723,724 A 2/1988 Bradley
4,828,195 A 5/1989 Hertel et al.
4,856,752 A 8/1989 Linn
4,962,897 A 10/1990 Bradley
4,988,052 A 1/1991 Urban
5,104,055 A 4/1992 Buxton
5,104,155 A 4/1992 Kirkwood
5,137,225 A 8/1992 Biagiotti
5,222,679 A 6/1993 Dropczynski et al.
5,226,611 A 7/1993 Butterworth et al.
5,249,756 A 10/1993 Biagiotti
5,259,910 A 11/1993 Biagiotti
5,267,703 A 12/1993 Biagiotti
5,285,979 A 2/1994 Francesco
5,312,059 A 5/1994 Membrino
5,368,252 A 11/1994 Biagiotti
5,368,253 A 11/1994 Harley
5,370,335 A 12/1994 Vigneau
5,402,960 A 4/1995 Oliver et al.
5,421,536 A 6/1995 Hertel et al.
5,431,357 A 7/1995 Rueegg
5,478,027 A 12/1995 Alexander
5,505,405 A 4/1996 Vigneau
5,538,199 A 7/1996 Biagiotti
5,542,622 A 8/1996 Biagiotti
5,593,106 A 1/1997 Cavanagh
5,603,467 A 2/1997 Perini et al.
5,614,059 A 3/1997 Boriani et al.
5,641,356 A 6/1997 Delmore et al.
5,653,401 A 8/1997 Biagiotti et al.
5,690,296 A * 11/1997 Biagiotti ..... B65H 18/28 242/521
5,769,352 A * 6/1998 Biagiotti ..... B65H 19/2269 242/521
5,772,149 A 6/1998 Butterworth
5,779,180 A 7/1998 Smedt et al.
5,820,064 A 10/1998 Butterworth
5,839,680 A 11/1998 Biagiotti
5,845,867 A 12/1998 Hould et al.
5,853,140 A 12/1998 Biagiotti
5,875,989 A 3/1999 Alexander
5,909,856 A 6/1999 Myer et al.
5,979,818 A 11/1999 Biagiotti et al.
6,000,657 A 12/1999 Butterworth
6,056,229 A 5/2000 Daul et al.
6,129,304 A 10/2000 Biagiotti
6,145,777 A 11/2000 Zach et al.
6,155,515 A 12/2000 Doerfel et al.
6,286,419 B1 9/2001 Wallace
6,422,501 B1 7/2002 Hertel et al.
6,494,398 B1 12/2002 De Matteis et al.
6,517,024 B1 2/2003 Gambini
6,565,033 B1 5/2003 Biagiotti
6,595,458 B1 7/2003 Biagiotti
6,595,459 B2 7/2003 Hanson
6,629,662 B2 10/2003 Howden et al.
6,655,629 B1 12/2003 Acciari
6,659,387 B2 12/2003 Biagioni et al.
6,676,063 B2 1/2004 Gambini
6,698,681 B1 3/2004 Guy et al.
6,715,709 B2 4/2004 Stephens et al.
6,729,572 B2 5/2004 Baggot et al.
6,752,344 B1 6/2004 Biagiotti
6,752,345 B2 6/2004 Betti et al.
6,866,220 B2 3/2005 Sosalla et al.
6,877,689 B2 4/2005 Butterworth
6,926,224 B2 8/2005 Foehr et al.
6,945,491 B2 9/2005 Gambini
6,948,677 B2 9/2005 Biagiotti
6,966,521 B2 11/2005 White
7,175,126 B2 2/2007 Perini
7,175,127 B2 2/2007 Butterworth et al.
7,222,813 B2 5/2007 Tsai
7,318,562 B2 1/2008 Biagiotti et al.
7,338,005 B2 3/2008 Biagiotti et al.
7,350,739 B2 4/2008 Maddaleni et al.
7,398,942 B2 7/2008 Benvenuti et al.
7,404,529 B2 7/2008 Biagiotti et al.
7,469,856 B1 12/2008 Tsai
7,494,086 B2 2/2009 Tsai
7,523,884 B2 4/2009 Gelli et al.
7,775,476 B2 8/2010 Recami et al.
7,802,748 B2 9/2010 De Matteis et al.
7,832,676 B2 11/2010 Gelli
7,887,003 B2 2/2011 Maddaleni et al.
7,891,598 B2 2/2011 Maddaleni et al.
7,896,284 B2 3/2011 Morelli et al.
7,931,226 B2 4/2011 Benvenuti et al.
7,947,153 B2 5/2011 Tsai
8,011,612 B2 9/2011 Gelli et al.
8,181,897 B2 5/2012 Tsai
8,186,612 B2 5/2012 Gelli et al.
8,210,462 B2 7/2012 Wojcik et al.
8,215,086 B2 7/2012 Maddaleni et al.
8,267,344 B2 9/2012 Maddaleni et al.
8,282,032 B2 10/2012 Tsai
8,302,900 B2 11/2012 Gambini
8,424,481 B2 4/2013 Tsai
8,459,587 B2 6/2013 Wojcik et al.
8,807,066 B2 8/2014 Räikkoönen
8,882,020 B2 11/2014 Lupi et al.
8,979,013 B2 3/2015 Gambini
9,365,379 B2 6/2016 Mazzaccherini et al.
9,586,779 B2 3/2017 Lupi et al.
9,604,810 B2 3/2017 Jendroska et al.
2003/0001042 A1 1/2003 Betti et al.
2005/0173585 A1 8/2005 Casella
2008/0111017 A1 5/2008 Gambini
2008/0223975 A1 9/2008 Planeta et al.
2008/0272223 A1 11/2008 Gambini
2009/0026299 A1 1/2009 Tsai
2009/0095836 A1* 4/2009 Maddaleni ..... B65H 19/2269 242/526
2009/0302146 A1 12/2009 Morelli et al.

(56) References Cited

U.S. PATENT DOCUMENTS

| | | | | |
|---|---|---|---|---|
| 2010/0133312 | A1* | 6/2010 | Tsai | B65H 19/2269 226/1 |
| 2010/0163665 | A1 | 7/2010 | Gambini | |
| 2010/0163666 | A1 | 7/2010 | Gambini | |
| 2010/0237179 | A1 | 9/2010 | De Matteis | |
| 2011/0133015 | A1 | 6/2011 | Gelli et al. | |
| 2012/0048985 | A1 | 3/2012 | Gambini | |
| 2013/0008995 | A1 | 1/2013 | Langella | |
| 2013/0020427 | A1 | 1/2013 | Gelli et al. | |
| 2013/0221150 | A1 | 8/2013 | Morelli et al. | |
| 2013/0284849 | A1 | 10/2013 | Mazzaccherini et al. | |
| 2014/0209730 | A1 | 7/2014 | Tanaka | |
| 2016/0001997 | A1 | 1/2016 | Maddaleni et al. | |
| 2017/0253448 | A1* | 9/2017 | Mellin | A47K 10/16 |
| 2017/0253449 | A1* | 9/2017 | Mellin | B65H 19/2269 |
| 2017/0253450 | A1* | 9/2017 | Mellin | A47K 10/16 |

FOREIGN PATENT DOCUMENTS

| | | | |
|---|---|---|---|
| CN | 101983907 | A | 3/2011 |
| CN | 201857145 | U | 6/2011 |
| CN | 101891076 | B | 5/2013 |
| DE | 1228223 | B | 11/1966 |
| DE | 2721883 | A1 | 11/1978 |
| DE | 2825154 | A1 | 12/1979 |
| DE | 3151256 | A1 | 10/1982 |
| DE | 3225518 | A1 | 3/1983 |
| DE | 8322778 | U1 | 11/1985 |
| DE | 8804614 | U1 | 5/1988 |
| DE | 8806890 | U1 | 7/1988 |
| DE | 9108164 | U1 | 9/1991 |
| DE | 4042169 | A1 | 7/1992 |
| DE | 4304469 | A1 | 8/1994 |
| DE | 29610198 | U1 | 10/1997 |
| DE | 29613556 | U1 | 12/1997 |
| DE | 19630923 | A1 | 2/1998 |
| DE | 102004000040 | A1 | 5/2006 |
| EP | 0078493 | A1 | 5/1983 |
| EP | 0118384 | A1 | 9/1984 |
| EP | 0514226 | A1 | 11/1992 |
| EP | 498039 | B1 | 12/1994 |
| EP | 0638500 | B1 | 5/1997 |
| EP | 0738231 | B1 | 1/1998 |
| EP | 968946 | B1 | 3/2003 |
| EP | 2436630 | A2 | 4/2012 |
| EP | 1982939 | B1 | 7/2013 |
| EP | 2669224 | A1 | 12/2013 |
| EP | 2676906 | A1 | 12/2013 |
| EP | 2669223 | B1 | 5/2014 |
| FI | 119763 | B | 3/2009 |
| FR | 1407836 | A | 8/1965 |
| GB | 259632 | A | 10/1926 |
| GB | 322400 | A | 12/1929 |
| GB | 666317 | A | 2/1952 |
| GB | 779662 | A | 7/1957 |
| GB | 796119 | A | 6/1958 |
| GB | 808758 | A | 2/1959 |
| GB | 856037 | A | 12/1960 |
| GB | 886774 | A | 1/1962 |
| GB | 944996 | A | 12/1963 |
| GB | 1065128 | A | 4/1967 |
| GB | 1071925 | A | 6/1967 |
| GB | 1094954 | A | 12/1967 |
| GB | 1179146 | | 1/1970 |
| GB | 1190850 | A | 5/1970 |
| GB | 1224569 | A | 3/1971 |
| GB | 1281473 | A | 7/1972 |
| GB | 1282387 | A | 7/1972 |
| GB | 1324183 | A | 7/1973 |
| GB | 1435525 | A | 5/1976 |
| GB | 1557038 | A | 12/1979 |
| JP | S57117446 | A | 7/1982 |
| JP | S57156944 | A | 9/1982 |
| JP | S5863644 | A | 4/1983 |
| JP | 58074446 | A | 5/1983 |
| JP | S58152750 | A | 9/1983 |
| JP | S58216854 | A | 12/1983 |
| JP | S6052449 | A | 3/1985 |
| JP | S60118562 | A | 6/1985 |
| JP | 2000218208 | A | 8/2000 |
| JP | 2001247237 | | 9/2001 |
| JP | 2008037511 | A | 2/2008 |
| NL | 192874 | B | 12/1997 |
| SE | 533751 | C2 | 12/2010 |
| SU | 296842 | A1 | 1/1971 |
| SU | 874553 | A1 | 10/1981 |
| SU | 925823 | A1 | 5/1982 |
| WO | WO9510472 | A1 | 4/1995 |
| WO | WO 9708088 | A1 | 3/1997 |
| WO | WO2004106201 | A1 | 12/2004 |
| WO | WO201004521 | A1 | 1/2010 |
| WO | WO201004522 | A | 3/2010 |
| WO | WO2010133037 | A1 | 11/2010 |
| WO | WO2011117827 | A1 | 9/2011 |

OTHER PUBLICATIONS

U.S. Appl. No. 15/439,295, filed Feb. 22, 2017, Mellin.
Jones, Greg, Winding area danger reduced, Pulp and Paper Europe, vol. 7, No. 6, p. 28 (May/Jun. 2002).
Johannsson, K., Winders—Automatic Supply of Machine Width Mandres, Revue A.T.I.P., vol. 38; Issue 4; pp. 185-187 (Apr. 1984).
PCT International Search Report, dated Jun. 14, 2017, 99 pages.
Grosskreutz, Martin, Continuous roll change in off-line calenders, Source: 88th Annual Meeting—Technical Section, Canadian Pulp and Paper Association, Preprints, vol. B, pp. B87-B91 (2002).

* cited by examiner

SURFACE WINDER FOR PRODUCING LOGS OF CONVOLUTELY WOUND WEB MATERIALS

FIELD OF THE INVENTION

The present disclosure relates to an apparatus for the production of convolutely wound rolls of web material. The present disclosure more particularly relates to a rewinding machine for the production of rolls of convolutely wound web material, for example convolutely wound rolls of bath tissue and paper toweling, so as to obtain small rolls of bath tissue paper, all-purpose drying paper, and the like.

BACKGROUND OF THE INVENTION

Paper is normally produced by continuous machines which, through the delivery of a stock of cellulose fibers and water distributed from headboxes, generate a ply of cellulose material on a forming fabric, which ply is dried and wound in reels of large diameter. These reels are subsequently unwound and rewound to form logs of smaller diameter. The logs are subsequently divided into rolls of dimensions equal to the dimension of the end product. With this technique, rolls of toilet paper, kitchen towels or other tissue paper products are normally manufactured.

Rewinding machines are used to produce convolutely wound rolls or "logs" of web material. Rewinders are used to convert large parent rolls of paper into retail sized rolls and bathroom tissue and paper towels. These rewinding machines typically wind a predetermined length of web material about a tubular winding core normally made of cardboard. These rolls or logs are then cut into a plurality of smaller-size rolls intended for commercial sale and consumer use. The tubular winding core section remains inside each convolutely wound roll of web material. In both cases the end product contains a tubular core made of material different from that forming the roll.

One type of rewinding machine, known as a surface rewinding machine (also referred to herein as a surface winder, or a rewinder), the rotational movement of the tubular core on which the roll or log is formed is provided by peripheral members in the form of rollers or rotating cylinders and/or belts with which the roll or log is kept in contact during formation.

A majority of surface winders are generally comprised of three principle winding rolls that perform the winding process. These rolls are the first winding roller (or upper winding roll (UWR)), the second winding roller (or lower winding roll (LWR)), and the third winding roller (or rider roll (RR)). The respective winding rolls are named due to where or how they contact a winding log. The UWR and LWR contact the winding log on the upper and lower portions respectively and the RR "rides" on the upper portion of the winding log as it increases in diameter as web material is wound thereabout while disposed between the UWR, LWR, and RR. The winding log enters the surface winder and is adhesively attached to the web material to be wound thereabout in a region of compression disposed between the UWR and LWR. The winding log is initially rotated by the UWR in a region disposed between the UWR and a stationary concave core cradle and rotationally translates to a region disposed intermediate the rotating, but stationary, UWR and LWR (known as the winding nest region). The RR contacts the surface of the rotating winding log in the winding nest region and translates away from the UWR and LWR as web material continues to be convolutely wound about the winding log.

Generally, in these surface wind systems, a web material is convolutely wound about a paperboard core having a 1.5" to 1.7" diameter and a length that corresponds to the width of the tissue parent roll which comes from the paper machine, usually 65" to 155". Several exemplary prior art surface winders (also called 'rewinders') are discussed infra.

FIG. 1 shows an exemplary prior art rewinder in which a web material N is fed from a supply parent roll through a perforation group 5 to the winding region of the rewinder. The rewinder has a first winder roller 15, around which the web material N is fed, and a second winder roller 17. The two rollers 15 and 17 each rotate in a counter-clockwise direction. The cylindrical surfaces of rollers 15 and 17 define a nip 19 through which the web material N is fed. A third roller 21 rotates in a counter-clockwise direction. The winder rollers 15, 17 and 21 define the region where the winding of each log is completed. Completed logs are routed along a chute 31 for further processing.

Disposed upstream of the nip 19 is a curved surface or track 33. The curved surface or track 33 and the cylindrical surface of the first winder roller 15 have a constant radius of curvature with its axis is coincident with the axis of the winder roller 15 and defines a channel 39 for the passage of the cores A between the first winder roller 15 and track 33.

The cores are introduced into the channel 39 by means of a conveyor 47. Disposed at regular intervals on the conveyor 47 are pushers 57 each of which picks up a core A. The cores A are removed by the pushers 57 and lifted and transferred, through a gluing unit, generally shown at 61, which may include a tank 63 of glue in which a series of discs 65 rotate. Such gluers are well-known and need not be described in greater detail. Core A is then transported to channel 39 to start the winding of each log.

The first winder roller 15 and the third roller 21 rotate at a peripheral speed equal to the web material N feeding speed, while the second winder roller 17 rotates at a temporary lower peripheral speed to allow the completed log L to be moved towards the chute 31. The core A1 is inserted into the channel 39 by the pusher 57.

As a new leading edge is produced, core A1 starts to rotate due to contact with stationary surface 33 and the rotating cylindrical surface of the winder roller 15. The core moves forward (i.e., downstream) by rolling along surface 33 at a speed equal to half the feeding speed of the web material N. The cross dimension of channel 39, which is slightly less than the diameter of the core A1 generates the friction is necessary for the angular acceleration of the core A1 from zero to the rolling speed, and the adhesion of the web material N to the surface of the core A1, on which glue has been spread by the gluing device 61. The resulting new leading edge is attached to the core A1 and the process continued.

FIG. 2 provides another prior art surface winder having a winding head 100 comprising first winding roller 103, second winding roller 105, and a third winding roller 107. Between the two winding rollers 103 and 105 there is defined a nip 111 for passage of the web material. Log L1 is formed inside the winding cradle defined by the three winding rollers 103, 105 and 107.

The cores A are fed along a feeder 147. Single winding cores A1 are picked up by a core inserter 149 after a longitudinal line of glue has been applied thereto by a glue applicator 151. The glued core is then placed proximate to the concave plate 117 disposed upstream of the nip 111. The path of the web material N1 extends around the first winding roller 103 and inside the channel 119 and then through the nip 111 to feed the web material N1 inside the winding cradle formed by the winding rollers 103, 105 and 107 which then disposed the web material N1 convolutely about the core A1.

FIG. 3 provides another exemplary prior art surface winder suitable for a winding operation of a roll L2 within the winding zone 214. Here, a core 210 having an initial glue 215 applied thereto is conveyed by a carrier 216 of a conveyor (not labeled) to the inlet end 209*a* of the curved channel 209. A push plate 217 having rotary movement and when contacting the core 210 pushes the core 210 into the curved channel 209. The core 210 is then driven by the first winding roller 204 and rolls forward.

After the web material w is broken, the leading edge w1 is wound around a new core 210 and the trailing edge w2 of the web material w is wound around the previous roll L2. The core 210 is then conveyed to the winding zone 214 to start a next cycle of the winding operation.

FIG. 4 provides still another exemplary prior art surface winder having at least one supply station 304 of support cores 305. The supply station 304 of the support cores 305 is provided with an advancing plane 306 on which abutment elements 307 operatively associated with the advancing plane 306 move the support cores 305 towards a joining and coupling station 308 of the machine 302. At the supply station 304, the machine 302 provides at least one application station 309 of glue 310 to a support core 305.

The application station 309 is provided with a mechanical application device 311 that, through the movement of application blade 312, picks up a predetermined quantity of glue 310 by dipping the application blade 322 into a housing tank 313 and deposits the glue 310 on the outer surface of the support core 305 rolling on the advancing plane 306. The machine 302 transports at least one web material N3 having a plurality of transverse spaced perforation and weakening lines to an outer portion of roller 317.

At conveying station 308, the support cores 305 having glue 310 disposed thereon and the web material N3 converge and contact each other. The web material N3 adheres to the outer surface of a respective support core 305. In short, loading device 318 pushes a respective support core 305 against the web material N3 disposed on the roller 317 so that the glue 310 bonds the respective support core 305 and the web material N3 together. Winding station 322 having two winding rollers 323, 324 then rotate the support core 305 to wind the web material N3 thereabout. Once winding is complete, the web material N3 is broken so that the last sheet of paper can be glued to the log of paper 303 before transfer to a subsequent packaging machine.

As shown in FIG. 5, an exemplary surface winder provides a core C2 retained above the core conveyor by a pivoting arm 438. When the arm 438 pivots to release the core C2, the core C2 is carried to the conveyor 435 by a core support guide 439. A line of adhesive 441 was previously applied to the core by an adhesive applicator 442.

The conveyor 435 deposits the core on an upstream holding portion 443 of the stationary plate 432. The core C3 does not contact the web N4 in the holding position.

When the perforation for the last sheet for the winding log L is just downstream of the core C3, the web N4 is severed at the desired perforation to form a leading edge. Rotation of the pinch arm 446 moves the core C3 so that the core C3 contacts the web N4 and begins to roll on the stationary plate 432. The stationary plate 432 and the holding portion 443 thereof can be provided with slots to permit the axially spaced pinch arms 446 to pass therethrough. As the core rolls on the stationary plate, the line of glue on the core C3 picks up the web N4 slightly upstream of the leading edge of the web N4, the web N4 is transferred to the core C3, and the leading end portion of the web N4 folds back over the outside of the glued portion of the web N4.

The core C3 which begins a new log L can move through the nip between the first winding roll 427 and the second winding roll 428 by moving the second winding roll away from the first winding roll 427 and/or changing the speed of the second winding roll 428 relative to the speed of the first winding roll 427.

As shown in FIG. 6, another exemplary surface winder provides for cores 511 to be picked up by a core inserter 549 after a longitudinal line of glue has been applied thereto by a glue applicator 551. The core inserter 549 translates the winding core 511 having glue disposed thereon to a point of entry into the introductory portion 512 of the surface rewinding machine disposed between the upper winding roll 503 having a web material N5 disposed about at least a portion thereof and the concave cradle 541. The region disposed between concave cradle 541 and upper winding roll 503 is winding cradle 513. The region disposed between leading edge device 514 and upper winding roll 503 forms the introductory portion 512 of winding cradle 513.

The rewinding machine comprises a first winding roller 503, a second winding roller 505, and a third winding roller 507. A nip 515 is defined between the two winding rollers 503 and 505 for passage of the web material to be wound about core A inside the winding cradle defined by the three winding rollers 503, 505 and 507.

However, current surface winders have limitations. For example, the core, prior to being inserted into the winding system, has an adhesive disposed upon it. As noted, the adhesive placed upon the core is intended to contact the web material coming into the UWR and cause it to fixably attach to the core via the adhesive disposed thereupon. The attachment of web material to the core via the core glue is sometimes referred to as core bonding.

The core having the adhesive disposed upon its surface is then mechanically transferred to the surface winding system. However, there are several degrees of freedom with such a system as the core glue is applied to the core, the core is transferred to the winding cradle and then a portion of the web material is then adhesively attached to the core. These numerous degrees of freedom provide a significant opportunity for misalignment, mis-attachment, and/or mis-insertion, etc. of the web material to the adhesive-laden core with such a system.

For example, as shown in FIG. 7, when a core is inserted into the region between the UWR and the cradle prior to insertion into the winding nest area, the core must undergo a transformation where the core surface speed must be accelerated from zero (i.e., has no surface speed at the point of entry) to the surface speed of the UWR (i.e., UWR running speed). In other words, the surface speed of the core is accelerated from zero to the surface speed of the UWR while disposed within the region between the cradle and the UWR. However, it has been observed that several mechanics-related principles in this region of the re-winder act to retard this required surface speed acceleration.

First, the entry portion of the cradle shown in FIG. 8 is positioned at a fixed point disposed orbitally about the UWR and typically has a smooth surface. A typical leading edge device is provided with a surface finish texture that is a generally smooth and polished. Leading edge device is typically affixed to the concave cradle shown in FIG. 7. The placement of a core having zero surface speed into the entry point of the winding cradle and the ensuing contact with the web material in contact with the UWR causes the core to slip (i.e., not spin) against this initial portion of the winding cradle. This slippage is represented by the arrow labeled "S" in FIG. 9. This slippage is believed to cause the core to oblongly deform into an ellipsoid shape.

A leading edge device having a generally smooth and polished finished surface can facilitate the sliding of a winding core disposed within the introductory portion of a winding cradle. Without desiring to be bound by theory, it is believed that winding core initially slips and does not immediately assume a rotational motion as it first contacts the surface of leading edge device and the moving web material having a velocity, v, contacting upper winding roll. Since the winding core has no rotational surface speed as it first contacts the surface of leading edge device and the moving web material, any adhesive disposed upon the core is now out of rotational position for attachment to the moving web material. For example, the glue-laden core (targeted to contact the web material in contact with the upper winding roll at a predetermined location immediately adjacent a perforation) will not contact the web material at the predetermined location causing several unfavorable results that result in mal-formed final product.

For example, if the web material attachment point to the core occurs at a point removed backwards from the region near a perforation (e.g., behind the perforation) present in web material, any excess leading web material can 'fold-back' upon the core and overlap the region of actual attachment of the web material to the core. This causes a consumer undesirable and unattractively wound product.

If the web material attachment point to the core occurs at a point removed forwards from the region near the perforation (e.g., ahead of the perforation) present in web material, the web material can fail to attach to the core. This can result in the adhesive disposed upon the core contacting the manufacturing equipment ultimately resulting in a process shut-down. Not only will the web material need to be re-threaded though the rewinder, but adhesive will also have to be removed from the surfaces of the rewinding equipment such as the winding cradle and UWR.

Net—If the winding core slides through the initial portion of the winding cradle, adhesive disposed upon the core can be deposited upon the surfaces of the rewinder. This is a significant manufacturing issue that can result in a process shut-down to remove adhesive from the surfaces of the rewinder such as first winding roller, second winding roller, third winding roller, concave cradle, winding cradle, and/or leading edge device.

One of skill in the art will understand that when a winding core rolls without slipping, the point of contact of the winding core has zero linear velocity relative to the surface of the leading edge device. When rolling with slipping occurs, the point of contact of winding core with the surface of leading edge device has a non-zero linear velocity relative to the surface of leading edge device. As the winding core effectively slides along (or upon) the surface of the leading edge device, kinetic friction, f, eventually reduces the linear (e.g., non-rotational) velocity of winding core relative to the surface of the leading edge device. This frictional, f, force also causes the winding core to start rotating about its center of mass (cm). The linear velocity along the surface of leading edge device of winding core decreases and the angular velocity, ω, of winding core increases until the non-slip condition $v_{cm}=R\omega$ is met. Then winding core rolls upon the surface of the leading edge device about its center of mass without slipping.

To work properly, the linear velocity, v, of the winding core must always equal the rate of rotation, ω, of the winding core multiplied by the radius, R, of the winding core from the center of rotation to the point of contact of the winding core with the upper winding roll. If the magnitude of the linear velocity at the edge of the rotating winding core does not equal the magnitude of the linear velocity of the center of rotation of the rotating core, then there must be slippage at the point of contact of the core with the upper winding roll or the surface of the leading edge device. This can result in the linear, non-rotating, movement of the core relative to the surface of the leading edge device because the center of rotation/mass of the core must move faster than the rotation of the upper winding roll can move it. The force of friction, f, from the surface of the leading edge device is the only force acting upon the surface of the core to cause the core to reduce its velocity, v, and increase the rotational velocity of the core to match the surface speed of the upper winding roll and the web material in contacting engagement therewith (e.g., in the rewinder described herein—also v).

Mathematically stated, at the point of insertion of the winding core into the introductory portion of winding cradle slipping and rolling forward provides $v_{cm}<R\omega$. Thus, the path of the core through the introductory portion of the winding cradle forms a prolate (contracted) cycloid because the traced out points on the surface of the generating circle that is slipping while rolling with $v_{cm}<R\omega$.

Second, the glue-laden core is targeted to contact the web material in at a predetermined location. Typically the targeted location on the web is immediately adjacent a perforation. If this targeted attachment location changes, the aforementioned unfavorable results can occur in the early stage formation of the wound material.

Finally, adhesive disposed upon the core can be deposited upon the surfaces of the rewinding equipment (e.g., the winding cradle and UWR) if the core slides through the initial portion of the winding cradle. This can result in the aforementioned process shut-down to remove adhesive from the surfaces of the rewinding equipment.

Thus, there is a clearly defined need to improve the correlation and placement of adhesive upon a core at a point that is closer to the point of insertion into the winding cradle, or placed upon the core within the winding cradle, to prevent the drawbacks observed by current surface winding equipment that meets current manufacturing financial and processing targets. This can provide a closer association of the position upon the core where the adhesive is disposed thereupon with the web material that is intended to be contacted thereto. This can also greatly simplify current surface winder architecture by eliminating for the external core glue application and core translation systems.

SUMMARY OF THE INVENTION

The present disclosure provides for a surface winder for winding a web material about a core having a radius, R, to obtain a log of convolutely wound web material. The surface winder comprises a core inserter for inserting the core into an introductory portion of a winding cradle. The introductory portion is defined by an upper winding roller, supplied from above with the web material directed towards the introductory portion at a velocity, v, and at a bottom by a concave cradle having a leading edge device. The concave cradle is associated downstream with a lower winding roller. The surface winder comprises a third oscillating roller arranged above the lower winding roller where the upper winding roller, lower winding roller, and third oscillating roller each having a respective axes parallel to each other and perpendicular to the feeding direction of the web material and cooperate with each other downstream of the introductory portion to form the winding cradle to convolutely wind the web material about the core to obtain the log. The leading edge device comprises a surface and has at least one channel disposed therein. The at least one channel has a single entry point and a single exit point and extends from a position external to the leading edge device and a first location disposed upon the surface. The first location disposed upon the surface is capable of receiving a fluid from the at least one channel. The fluid is fluidically displaced onto the core from the at least one channel when the core is in contacting engagement with the first location disposed upon the surface.

The present disclosure also provides for a surface winder for winding a web material around a core having a radius, R, to obtain a log of convolutely wound web material. The surface winder comprises a core inserter for inserting the core having a plurality of rugosities disposed upon a surface thereof into an introductory portion of a winding cradle. The introductory portion is defined by an upper winding roller, supplied from above with the web material directed towards the introductory portion at a velocity, v, and at a bottom by a concave cradle having a leading edge device operatively attached thereto. The concave cradle is associated downstream with a lower winding roller. The surface winder comprises a third oscillating roller arranged above the lower winding roller where the upper winding roller, sad lower winding roller, and third oscillating roller each having a respective axes parallel to each other and perpendicular to the feeding direction of the web material and cooperate with each other downstream of the introductory portion to form the winding cradle to convolutely wind the web material about the core to obtain the log. The leading edge device comprises a surface having a texture disposed thereon. The texture reduces slippage of the core when the core is disposed within the introductory portion and the rugosities disposed upon the core facilitate attachment of the web material to the core.

DETAILED DESCRIPTION

Figure 1:
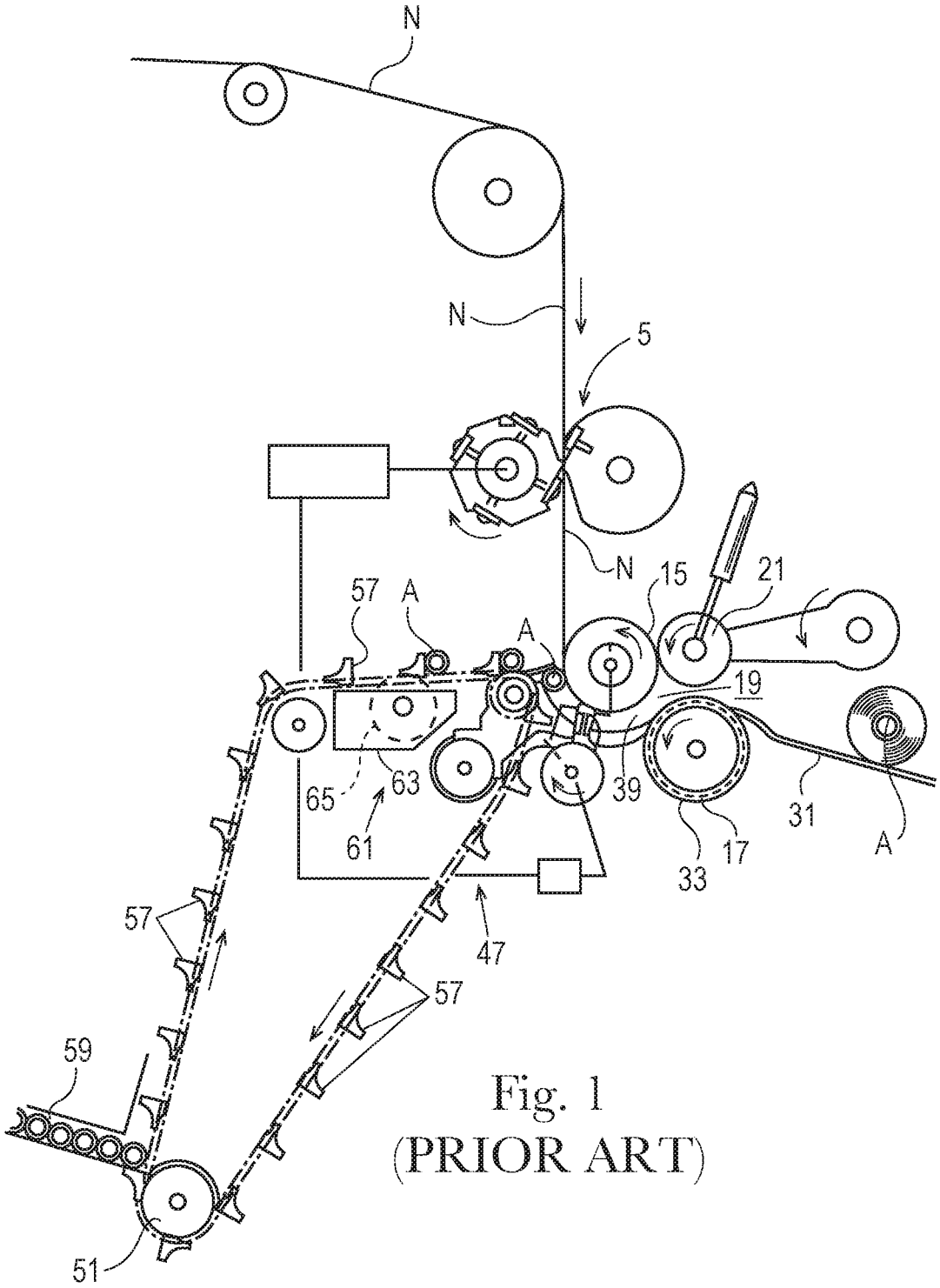
Fig. 1 (PRIOR ART)
FIG. 1 is a cross-sectional view of an exemplary prior art surface rewinding machine winder including a core in-feed apparatus showing the transport of a winding core that has glue disposed upon a surface thereof.
Figure 2:
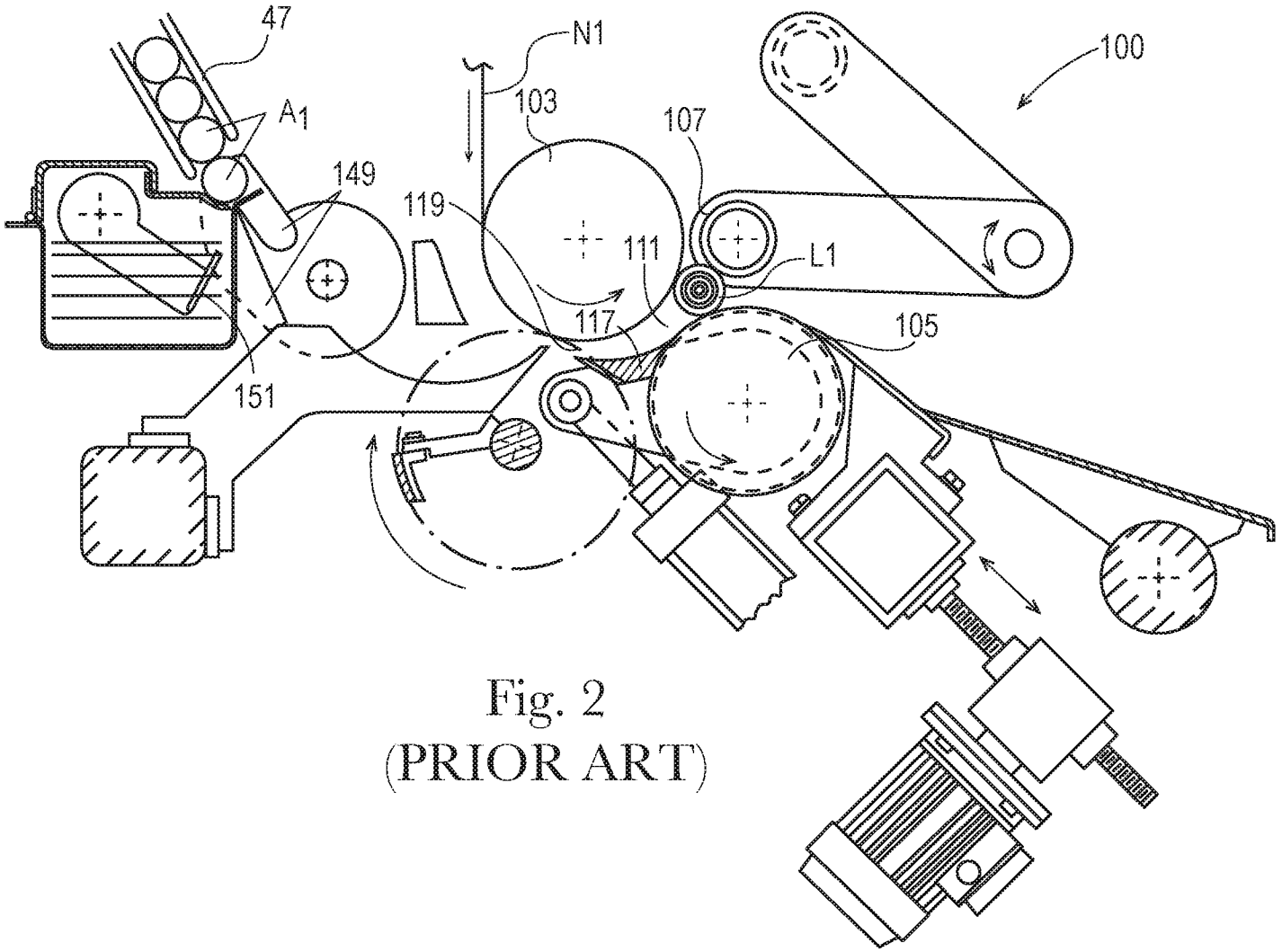
Fig. 2 (PRIOR ART)
FIG. 2 is a cross-sectional view of another exemplary prior art surface rewinding machine winder including a core in-feed apparatus showing the transport of a winding core that has glue disposed upon a surface thereof.
Figure 3:
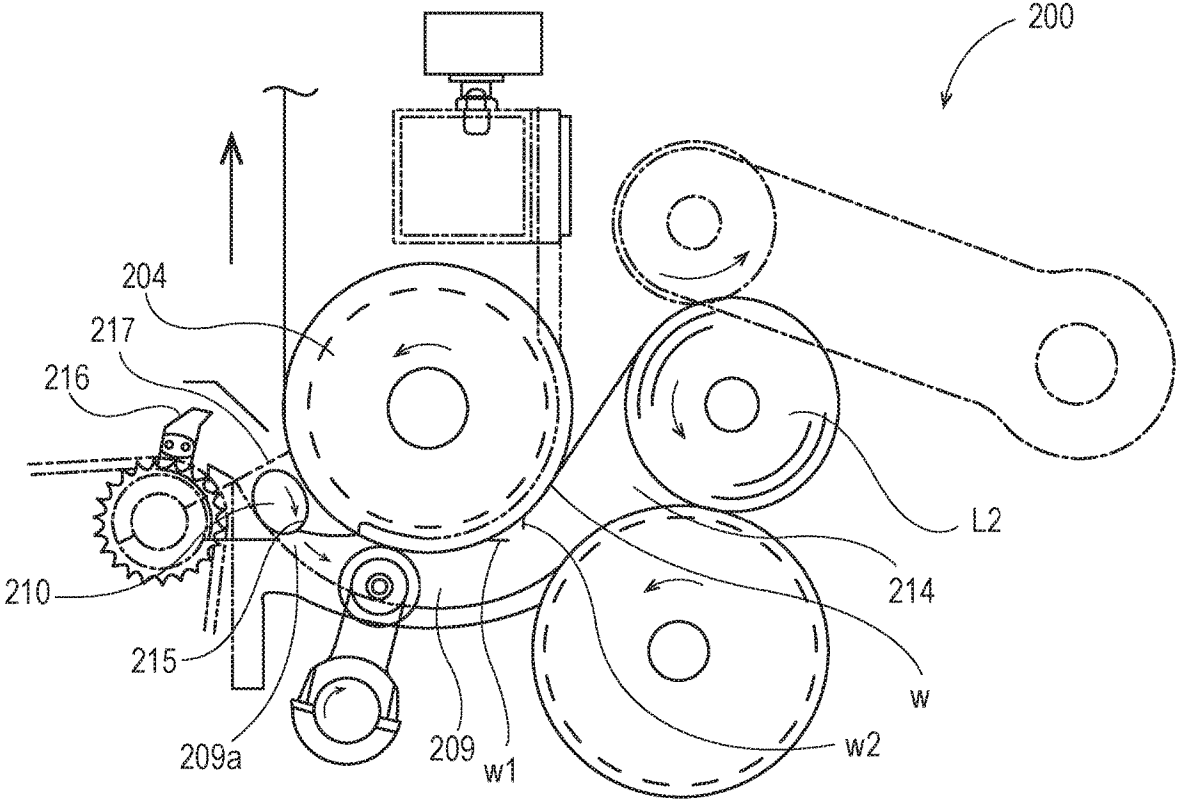
Fig. 3 (PRIOR ART)
FIG. 3 is a cross-sectional view of yet another exemplary prior art surface rewinding machine winder including a core in-feed apparatus showing the transport of a winding core that has glue disposed upon a surface thereof.
Figure 4:
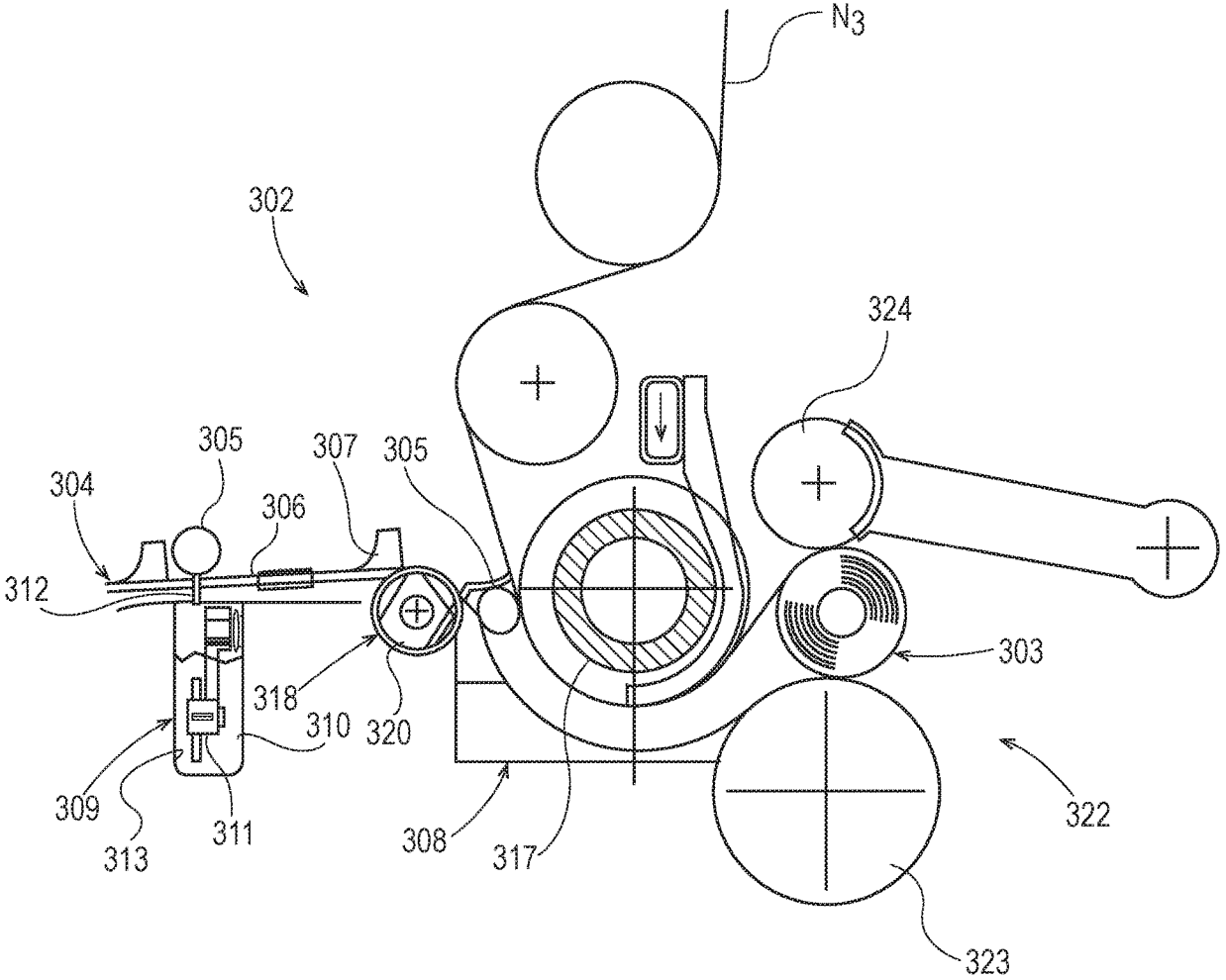
Fig. 4 (PRIOR ART)
FIG. 4 is a cross-sectional view of still yet another exemplary prior art surface rewinding machine winder including a core in-feed apparatus showing the transport of a winding core that has glue disposed upon a surface thereof.
Figure 5:
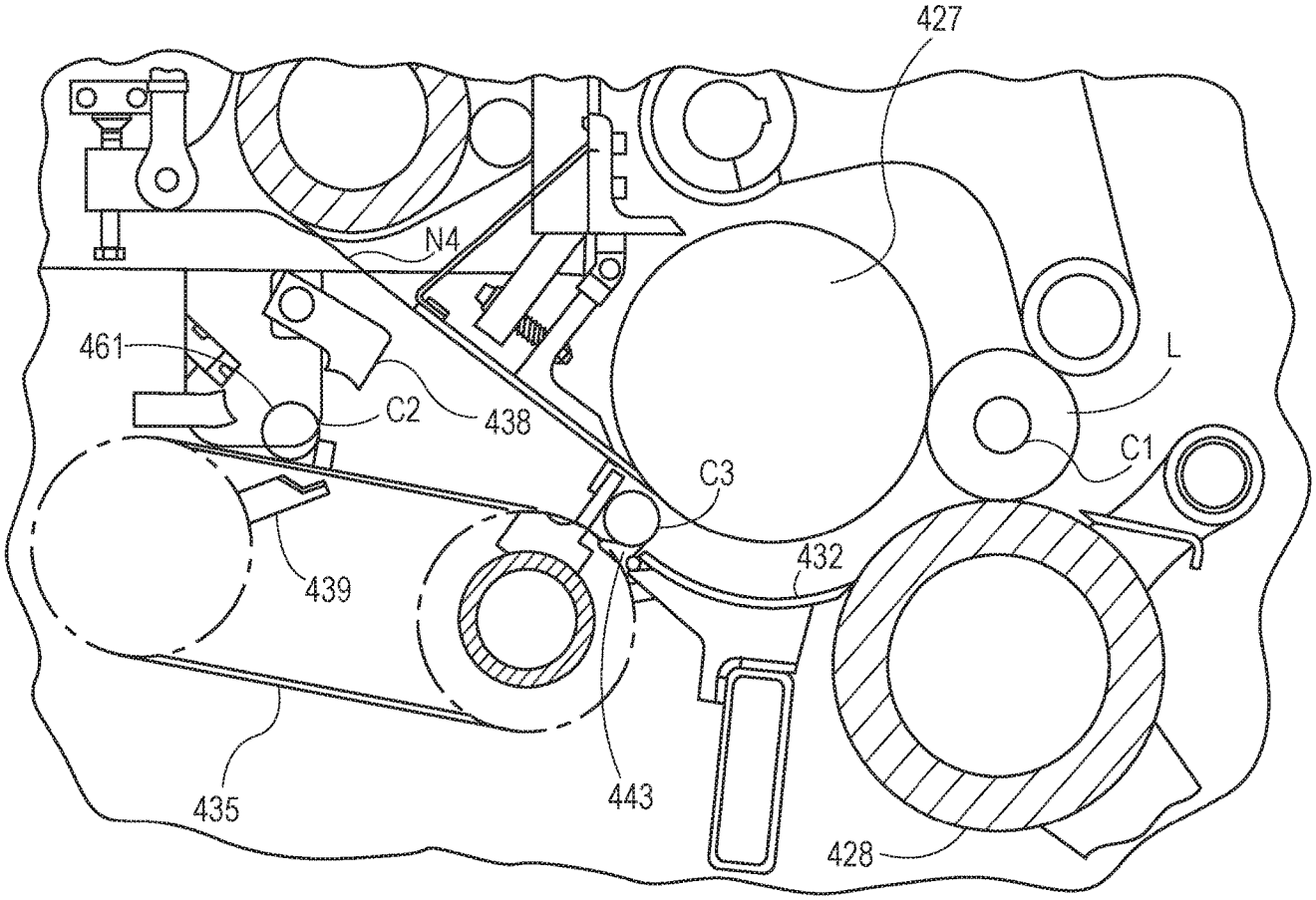
Fig. 5 (PRIOR ART)
FIG. 5 is a cross-sectional view of another exemplary prior art surface rewinding machine winder including a core in-feed apparatus showing the transport of a winding core that has glue disposed upon a surface thereof.
Figure 6:
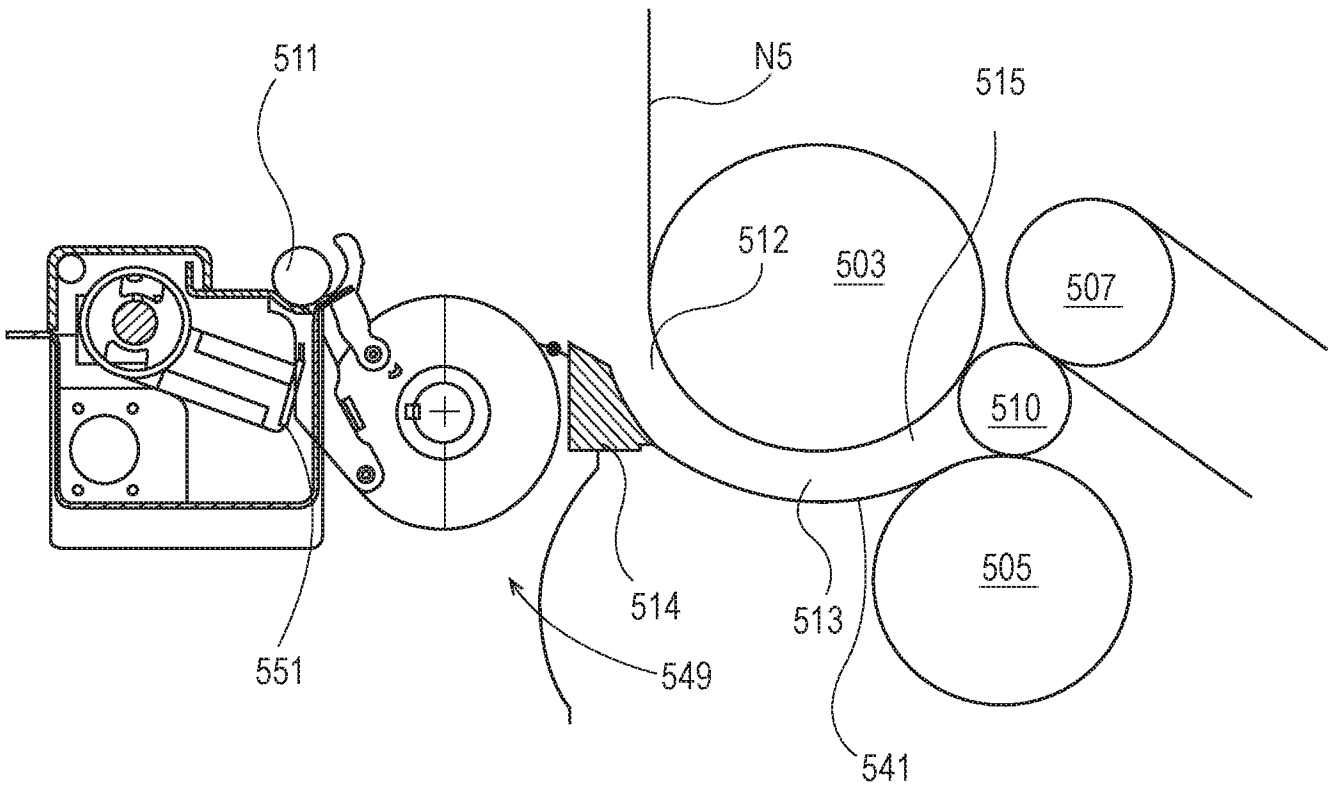
Fig. 6 (PRIOR ART)
FIG. 6 is a cross-sectional view of still another exemplary prior art surface rewinding machine winder including a core in-feed apparatus showing the transport of a winding core that has glue disposed upon a surface thereof.
Figure 7:
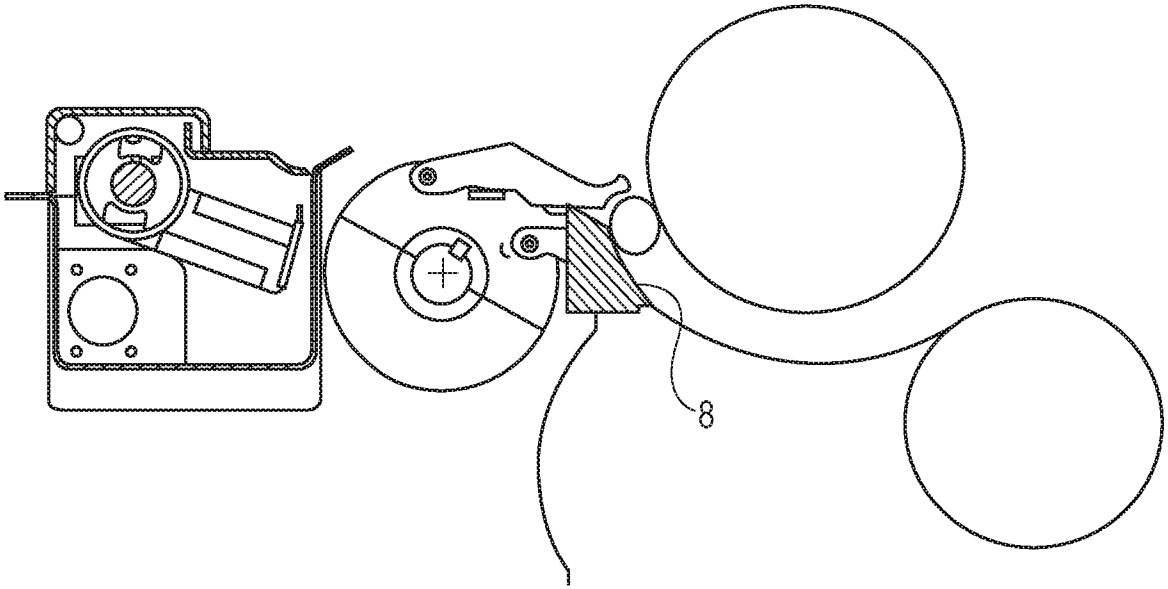
Fig. 7 (PRIOR ART)
FIG. 7 is a cross sectional view of an exemplary prior art surface winder having a winding core having an adhesive previously applied thereto disposed at the introductory portion of a winding cradle.
Figure 8:
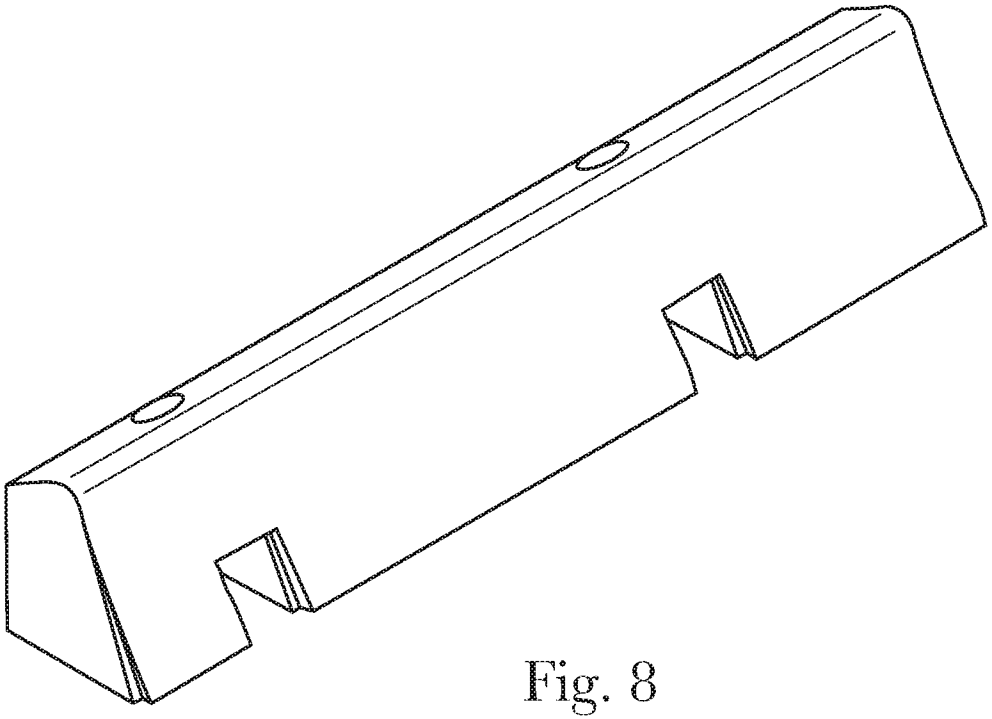
Fig. 8 (PRIOR ART)
FIG. 8 is a perspective view of an exemplary prior art introductory portion of the winding cradle of the region labeled 8 in FIG. 7 having a smooth surface.
Figure 9:
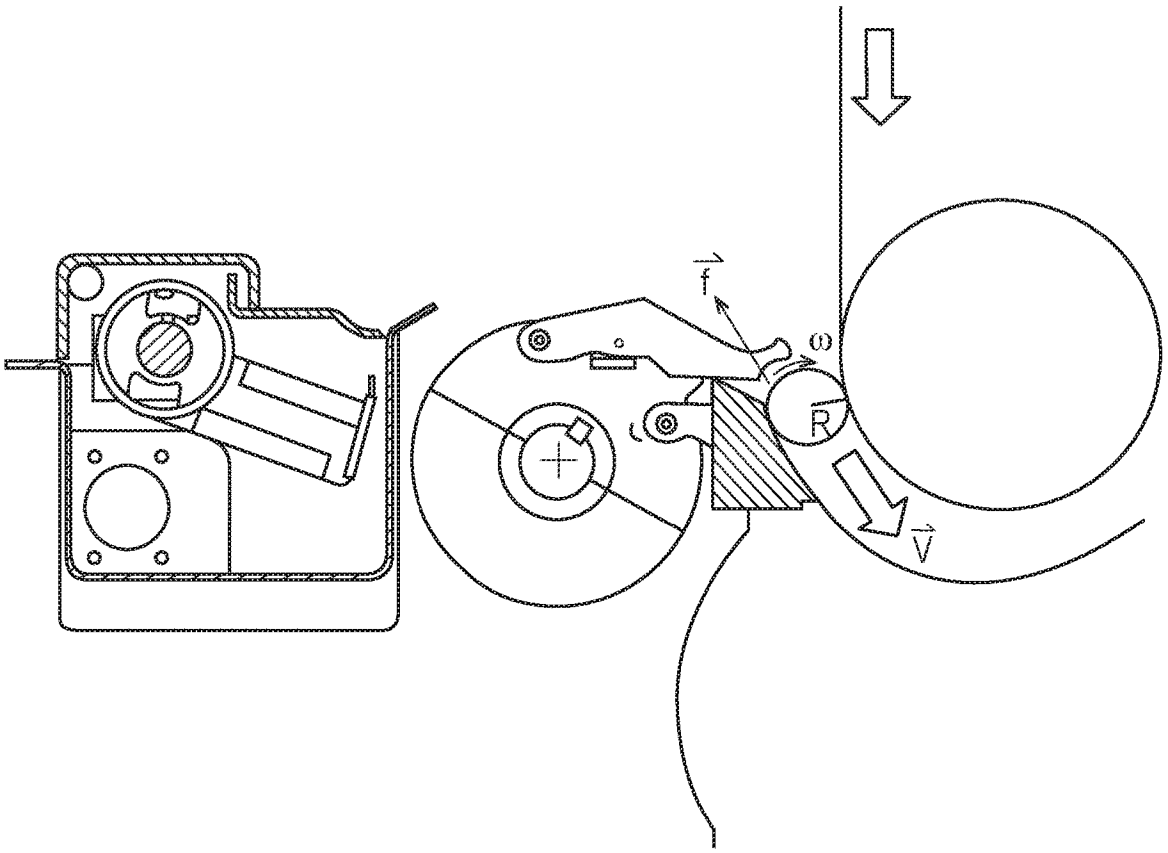
Fig. 9 (PRIOR ART)
FIG. 9 is a cross-sectional view of an exemplary surface prior art winding machine showing a core having an adhesive applied previously thereto 'slipping' through the introductory portion of the surface rewinding machine while disposed between the upper winding roll and the winding cradle due to the introductory portion of the winding cradle having a smooth surface.
Figure 10:
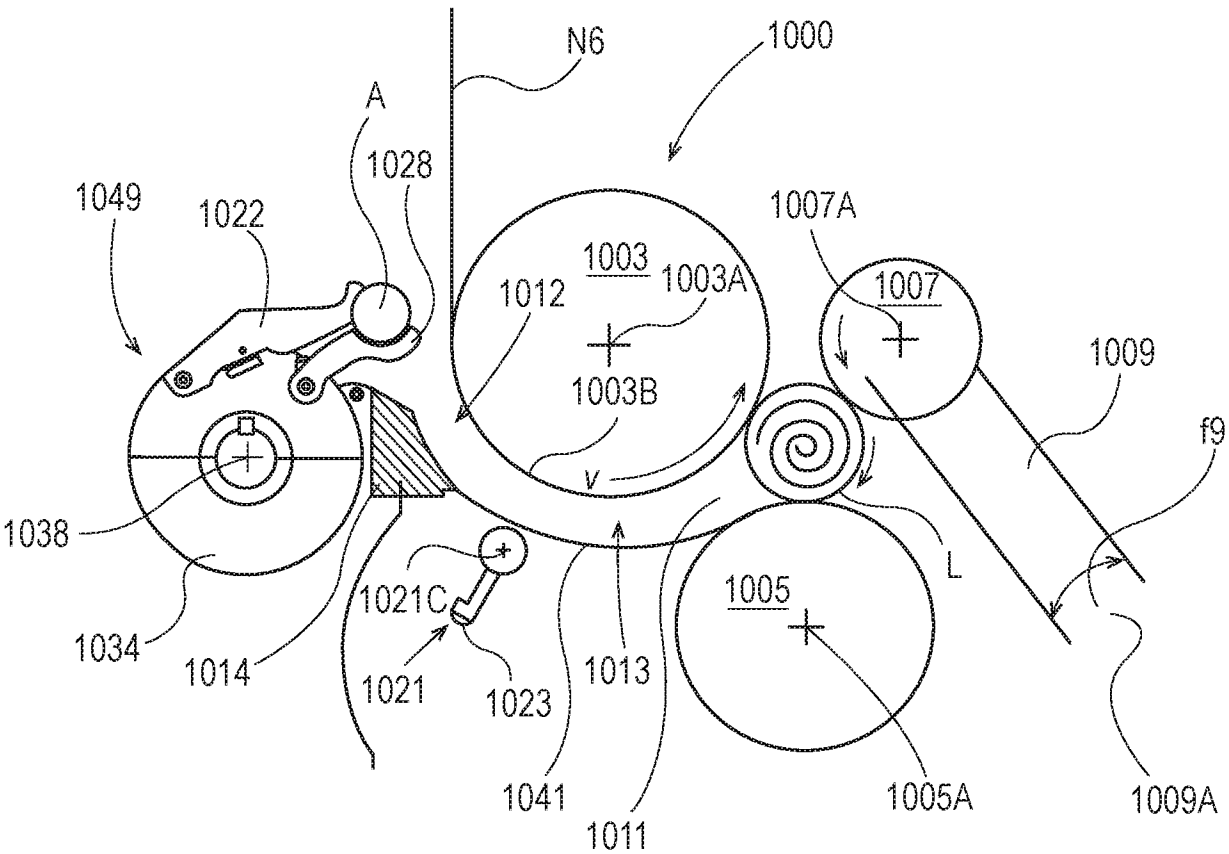
FIG. 10 is a cross-sectional view of an exemplary surface rewinding machine having an exemplary introductory portion and ready to insert a core having no adhesive disposed thereon as described by the present disclosure.

An exemplary embodiment of a new rewinder 1000 consistent with the description supra is shown in FIG. 10. As presented, FIG. 10 shows the main members of the rewinder 1000, and in particular the members intended to feed the winding cores A and the winding rollers.

As shown, the winding head of the rewinding machine comprises a first winding roller 1003 (also referred to herein as upper winding roll 1003) with a rotation axis 1003A, a second winding roller 1005 (also referred to herein as lower winding roll 1005) rotating about a rotation axis 1005A and a third winding roller 1007 (also referred to herein as rider roll 1007) rotating about a third rotation axis 1007A. A nip 1011 is defined between the two winding rollers 1003 and 1005 for passage of the web material N6, having a speed, v, which can be equal to the surface speed of upper winding roll 1003 wound about a core A.

In some embodiments the axis 1003A of the first winding roller 1003 is fixed with respect to a load bearing structure (not shown) of the rewinder 1000. In other embodiments the axis 1003A can be moving with respect to the load bearing structure (not shown).

In some embodiments the axis 1005A of the second winding roller 1005 is movable. In some embodiments the axis 1005A can be moved to produce logs with a winding core A. In other embodiments, the rotation axis 1005A of the second winding roller 1005 can be movable in a controlled manner also during each winding cycle of logs upon a core A having a variable diameter. Ideally, the axis 1005A of the second winding roller 1005 can be movable to adapt the machine to winding cores A or mandrels having different diameters. In any regard, the first winding roller 1003 can have a moving axis 1003A for the same reasons indicated above. Further, both the winding rollers 1003 and 1005 can be movable and adjustable.

The third winding roller 1007 is advantageously carried, for example, by a pair of arms 1009 pivoting with a reciprocating movement according to the double arrow f9 about a pivoting axis 1009A. The movement according to the double arrow f9 enables the third winding roller 1007 to move toward or away from the first winding roller 1003 and second winding roller 1005 according to the diameter of the log L during the step of formation inside the winding cradle defined by the three winding rollers 1003, 1005 and 1007.

The exemplary prior art rewinding machine 1000 can be provided with a concave cradle 1041. The concave cradle 1041 is in actual fact preferably formed by a series of mutually parallel shaped plates, only one of which is visible in the drawing and the others being superimposed thereon. The various shaped plates all have a concave edge forming a concave surface for rolling of the winding cores.

Single winding cores A can be picked up by a core inserter 1049 and inserted into introductory portion 1012 of winding cradle 1013. Cam housing 34 of core inserter 1049 can be provided with a cam disposed within cam housing 1034 that defines the orbital motion of movable finger 1028 attached thereto about the longitudinal axis of core inserter 1049. The cam can be provided with any desired profile required by the manufacturing operation to provide the desired motion about the longitudinal axis 1038.

In this regard, movable finger 1028 can emanate from a centroid of cam housing 1034 in a manner that causes cam housing 1034 to orbit about the longitudinal axis 1038 of cam-controlled core inserter 1049. As cam housing 1034 orbits about the longitudinal axis 1038 while disposed in contacting and moveable engagement with cam housing 1034, cam housing 1034 can define the motion of movable finger 1028 relative to the longitudinal axis 1038, fixed finger 1022, and winding core A. Providing a cam housing 1034 system to control the movement of movable finger 1028 of cam-controlled core inserter 1049 can provide a more reliable and consistent contact and release system for the insertion of a winding core A into the introductory portion 1012 of winding cradle 1013.

As the fixed fingers 1022 of core inserter 1049 approach the introductory portion 1012 of winding cradle 1013, winding core A remains in contacting engagement with fixed finger 1022 and movable finger 1028 of cam-controlled core inserter 1049 as the winding core A approaches the introductory portion 1012 of winding cradle 1013. Core inserter 1049 can provide more certainty relative to the insertion of a winding core A into the introductory portion 1012 of winding cradle 1013.

Moving member 1021 can be used to sever the web material N6. Winding starts on the central core A and member 1021 does not perform any function in relation to this action, except for an optional effect of accompanying the leading edge toward the new winding core A that is inserted into the channel formed between the winding roller 1003 and the cradle 1041 upstream (with respect to the direction of feed of the web material N6) of the moving member 1021.

Interaction between the concave cradle 1041 and the moving member 1021 is permitted by the fact that the former has a comb shaped structure formed by a plurality of parallel plates. In this way, the pads 1023 of the moving member 1021 can pass between adjacent plates and enter the feed channel of the winding cores A formed between the concave surface of the cradle 1041 and the cylindrical surface 1003B of the winding roller 1003. The concave cradle 1041 can be supported about the rotation axis 1021C of the moving member 1021. The moving member passes from an idle position to an operating position by pivoting about the rotation axis 1021C. Pivoting can be controlled by a piston-cylinder actuator. Additionally, moving member 1021 can be provided with a reciprocating oscillatory or rotary movement around the axis. The moving member 1021 preferably rotates in clockwise direction to come into contact with the web material N6 and pinch it against the cylindrical surface of the winding roller 1003 and perform severing of the web material N6.

As mentioned previously, single winding cores A are picked up by a core inserter 1049 and translated to a point of entry into the introductory portion 1012 of the surface rewinding machine 1000 disposed between the upper winding roll 1003 having a web material N6 disposed about at least a portion thereof and the concave cradle 1041. The region disposed between concave cradle 1041 and upper winding roll 1003 is referred to herein as winding cradle 1013. The region disposed between leading edge device 1014 and upper winding roll 1003 forms the introductory portion 1012 of winding cradle 1013. While it is possible for web material N6 to have a velocity, v, that is different from the surface velocity of upper winding roll 1003 about its longitudinal axis 1003A, for purposes of discussion herein, it can be presumed that the velocity, v, of web material N6 is the same as the surface velocity, v, of upper winding roll 1003 about its longitudinal axis 1003A.

Figure 11:
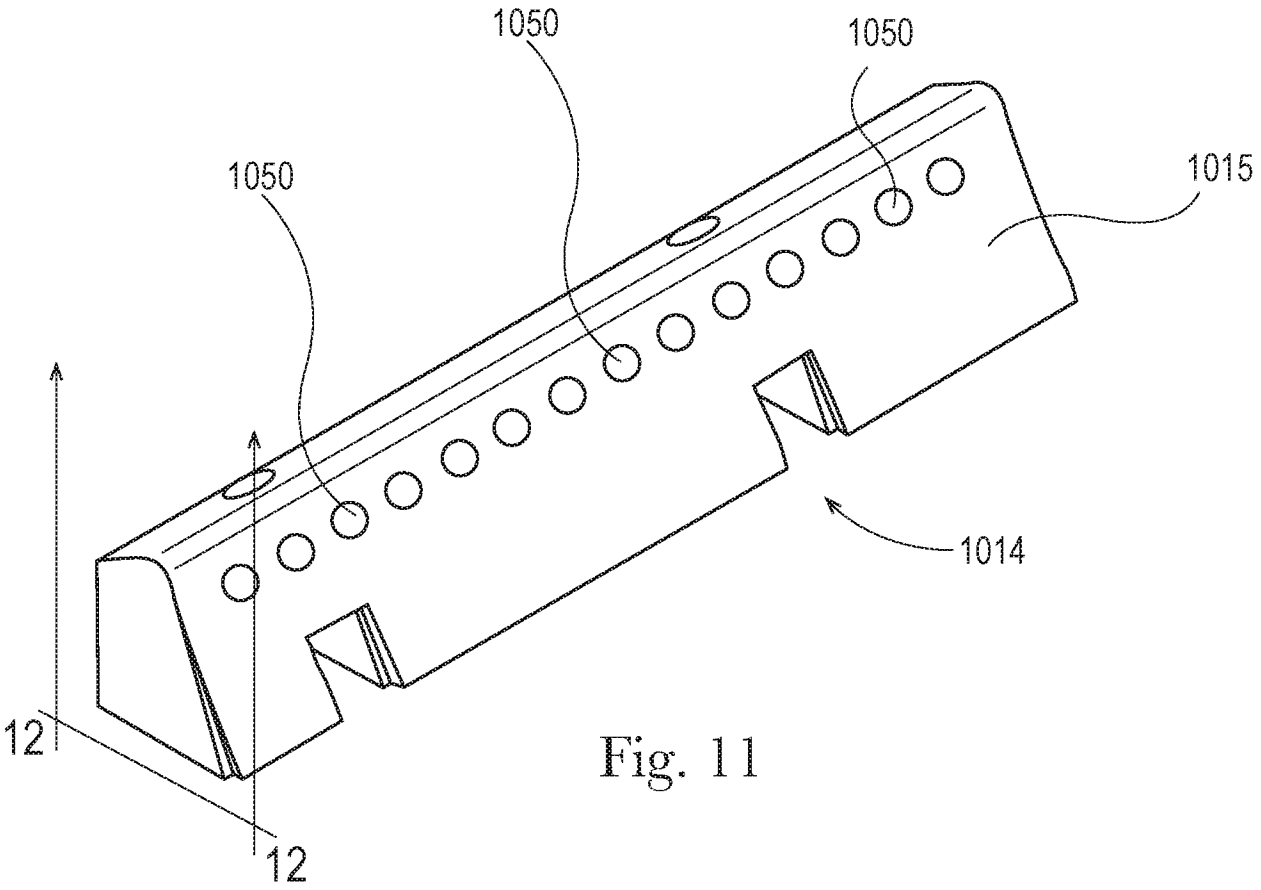
FIG. 11 is a perspective view of an exemplary introductory portion for a surface rewinding machine.

The present disclosure provides a unique introductory portion 1012 of winding cradle 1013 for insertion of the winding core A into the introductory portion 1012 of winding cradle 1013 of rewinder 1000. As shown in FIG. 11, the unique leading edge device 1014 incorporated into introductory portion 1012 of winding cradle 1013 can effectively eliminate the need for a rewinder 1000 system to incorporate a glue applicator as well as the associated storage capability/capacity for the storage of glue to be disposed upon a particular core A prior to insertion into the introductory portion 1012 of winding cradle 1013.

As shown in FIGS. 11-14, leading edge device 1014 can be provided with at least one pressure-sensitive valve 1050 provided upon or recessed within surface 1015 of leading edge device 1014. A source of glue or other fluid can be supplied to pressure-sensitive valve 1050 via a channel 1052 disposed within leading edge device 1014 so that glue or any other fluid can be supplied from a glue or fluid source disposed external to leading edge device 1014 and provided in fluid communication with pressure-sensitive valve 1050 via channel 1052.

Referring again to FIGS. 10-14, in operation, a core A is disposed at the introductory portion 1012 of rewinder 1000 upon the surface 1015 of leading edge device 1014 by core inserter 1049. As core A progresses into eventual contacting engagement with upper winding roll 1003 and/or web material N6 it concurrently progresses along surface 1015 of leading edge device 1014 in eventual rotating engagement with surface 1015 of leading edge device 1014. As core A is rotarily transported across surface 1015 of leading edge device 1014 while in contacting engagement with web material N6 and/or upper winding roll 1003, core A will assume contacting engagement with pressure sensitive valve 1050. As core A contactingly engages pressure-sensitive valve 1050, pressure-sensitive valve 1050 opens allowing glue, adhesive, or other fluid disposed within channel 1052 to fluidly migrate past the surface of pressure-sensitive valve 1050 and into contacting engagement with the surface of core A. Core A, now having glue or fluid disposed upon a surface thereof can then rotate into contacting engagement with web material N where web material N is then contactingly and releaseably engaged with core A via the glue or fluid disposed upon a surface thereof.

One of skill in the art will readily recognize that the deposition of glue or fluid upon core A while disposed within introductory portion 1012 can facilitate the more accurate placement and/or attachment of the web material N6 at a portion of web material N6 that is disposed adjacent a CD-oriented perforation. This can reduce and even remedy the undesirable attributes associated with the placement of glue upon core A by an external process and translating the glue-laden core A from the glue application device to the introductory portion 1012 as discussed supra.

By way of example only, glue can be disposed upon the surface of a core A that is disposed in contacting engagement with both the surface 1015 of leading edge device 1014 and the web material N6 that is engaged with the surface of upper winding roll 1003 of rewinder 1000 that is in complete rotational and translational control. Thus the glue can be disposed upon a portion of the surface of core A and immediately rotate into a pre-determined and/or desired location disposed upon the surface of web material N6. This pre-determined and/or desired location disposed upon the surface of web material N6 can be provided immediately adjacent a CD-oriented perforation disposed within web material N6.

A shown in FIG. 11, a plurality of pressure-sensitive valves 1050 can be provided within or upon the surface 1015 of leading edge device 1014. The plurality of pressure-sensitive valves 1050 can be provided with any desired positioning upon the surface 1015 of leading edge device 1014. Any desired positioning can be provided in any desired configuration upon the surface 1015 of leading edge device 1014 to include sinusoidal, saw-tooth, square, collectively elongate, and/or combinations thereof. Thus, one of skill in the art would be able to provide glue upon the surface of core A in a manner that provides the most efficacious fastening of web material N6 upon core A via the glue disposed thereon.

Figure 12:
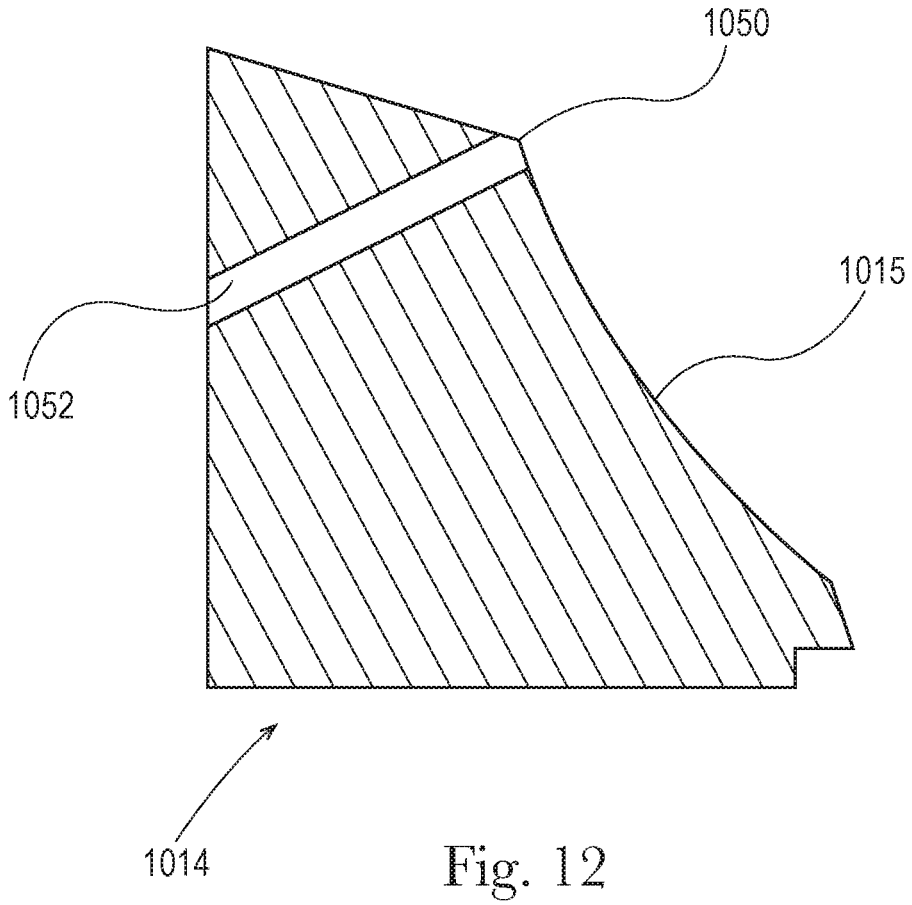
FIG. 12 is a cross-sectional view of the exemplary introductory portion taken at 12-12 of FIG. 10.
Figure 13:
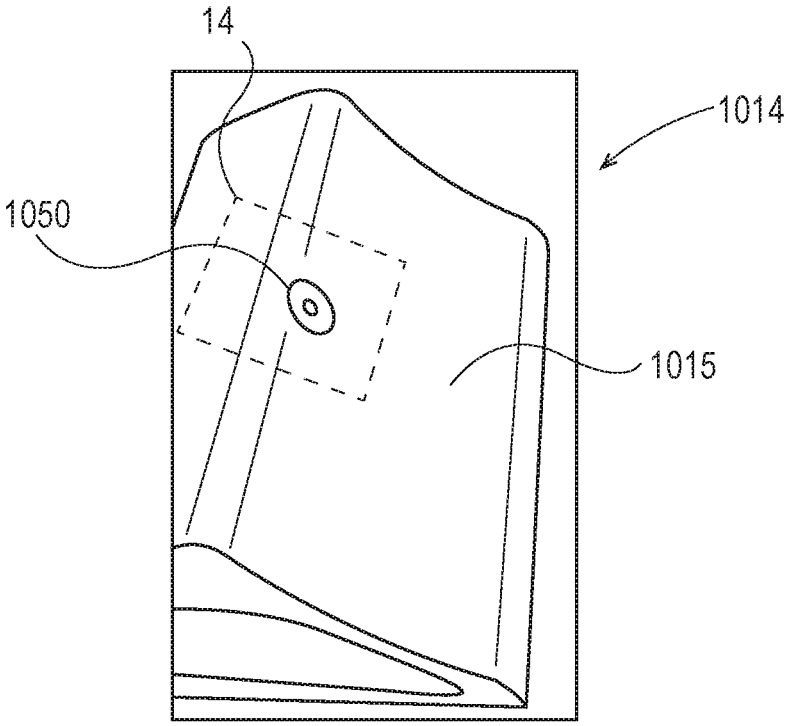
FIG. 13 is a photograph showing a perspective view of an exemplary introductory portion for a surface rewinding machine having a pressure-sensitive valve disposed within a surface thereof.
Figure 14:
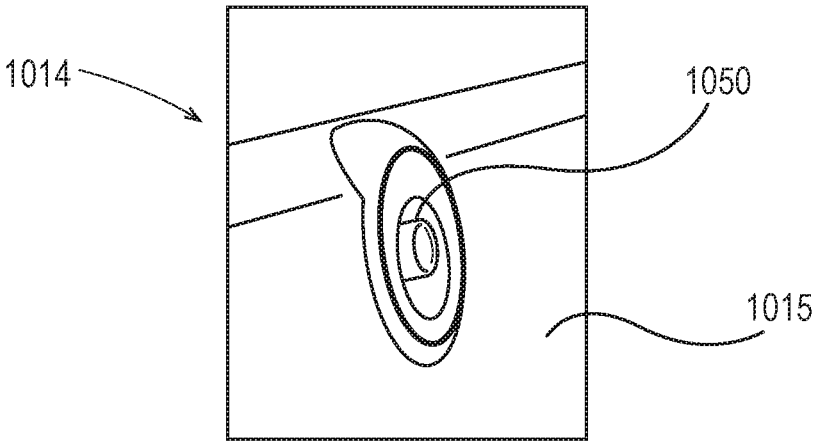
FIG. 14 is a photograph of the portion labeled 14 of the photograph of FIG. 13.

As shown in FIG. 12, each pressure-sensitive valve 1050 can be supplied with glue, adhesive, or other fluid through an individual channel 1052 associated with a respective pressure-sensitive valve 1050 associated thereto. Alternatively, a plurality of pressure-sensitive valves 1050 can be supplied with glue, adhesive, or other fluid through an individual channel 1052 associated with the plurality pressure-sensitive valve 1050 associated thereto through internal plumbing that would be recognized by one of skill in the art or through the connection of each respective pressure-sensitive valve 1050 of a given plurality of pressure-sensitive valves 1050 through a manifold that provides contacting engagement of a respective or plurality of channels 1052 with the plurality of pressure-sensitive valves 1050. Such plumbing architecture can be provided with methods known in the art as additive manufacturing and all of its industrially known equivalents.

A valve suitable as a pressure-sensitive valve 1050 is the SOLO GLUE RITER® Applicator available from Gluefast Adhesives & Applicating Equipment, Neptune, N.J.

One of skill in the art would understand that it can be desirable to provide the winding core A with pure rolling motion at the point of contact with upper winding roll 1003 and the surface 1015 of leading edge device 1014. In this way, the rolling of winding core A becomes a combination of both translational and rotational motion. In this way, when winding core A experiences pure translational motion, all of its points move with the same velocity as the center of mass (e.g., in the same direction and with the same speed ($v=v_{cm}$). Further, when the winding core A experiences pure rotational motion about its center of mass, all of its points move at right angles to the radius, R, in a plane perpendicular to the axis of rotation, so that points on opposite sides of the axis of rotation of winding core A move in opposite directions, move with a speed proportional to radius ($v=R\omega$), so that the center of mass does not move (since R=0) and points on the outer radius of winding core A move with speed $v=R\omega$, and move in a circle centered on the axis of rotation (also the center of mass).

An exemplary leading edge device 1014 can be provided with a surface 15 that has a texture provided thereto. Without desiring to be bound by theory, it is believed that providing a leading edge device 1014 with a finish texture upon surface 1015 that can reduce the slippage of a respective winding core A inserted into the introductory portion 1012 of winding cradle 1013.

Figure 15:
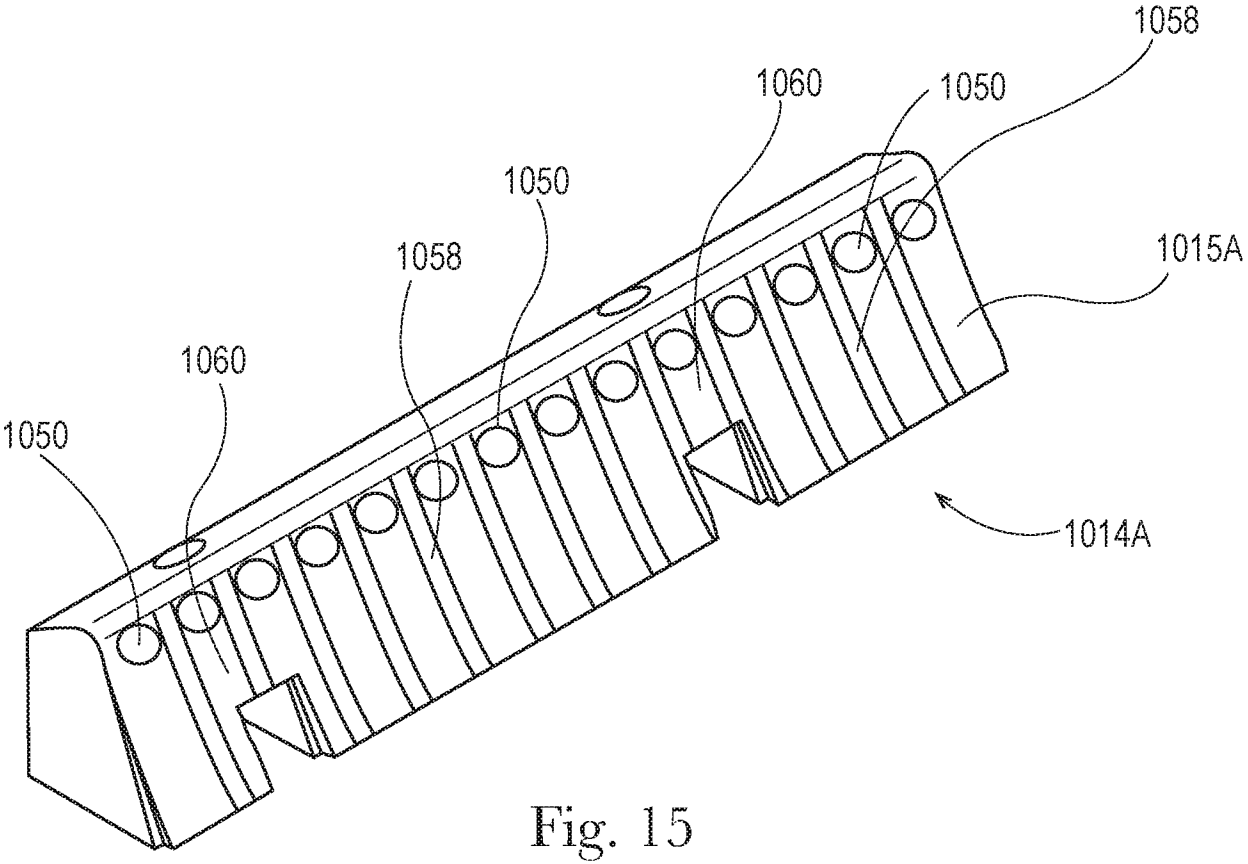
FIG. 15 is a perspective view of another exemplary introductory portion for a surface rewinding machine.

In the exemplary, but non-limiting, alternative embodiment shown in FIG. 15, the surface 1015A of leading edge device 1014A can be provided with a finish texture comprising a plurality of raised areas (or ridges) 1058 and/or a plurality of recessed areas 1060 relative to the surface 1015A of leading edge device 1014A that can assist in providing the winding core A with a pure rolling motion at the point of contact with upper winding roll 1003 and the surface 1015A of leading edge device 1014A. As depicted, the plurality of raised areas 1058 and/or plurality of recessed areas 1060 can be MD-oriented relative to the movement of the core A through the rewinder 1000.

The raised areas 1058 can each be provided by at least one respective pressure-sensitive valve 1050. However, one of skill in the art could provide any number of raised areas 1058 with any number of pressure-sensitive valves 1050 that provide the desired amount of glue, adhesive, and/or other fluid upon a core A that is provided in contacting and pressured engagement thereto. In any regard, a core A presented in contacting engagement with leading edge device 1014A can be facilitated in obtaining rotational motion through the leading edge device 1014A and have glue disposed at a location (pre-determined or otherwise) thereon upon contacting engagement with the respective pressure-sensitive valves 1050 disposed upon any number of the raised areas 1058 disposed upon the surface 1015A.

Additionally, any number of the recessed areas 1060 can facilitate removal of any excess glue, adhesive, and/or fluid that is not in contacting engagement with a core A. For example, any excess glue, adhesive, and/or fluid that are not in contacting engagement with a core A can overflow into a recess and be re-directed away from any downstream manufacturing equipment comprising rewinder 1000. One of skill in the art could even provide glue, adhesive, and/or fluid reclamation equipment and/or systems in fluid engagement with any number of recessed areas 1060. For example, each recessed area can be operative connected to a glue, adhesive, and/or fluid removal channel (not shown) that redirects any excess glue, adhesive, and/or fluid away from leading edge device 1014A. Alternatively, each recessed area can be operative connected to a glue, adhesive, and/or fluid removal reservoir (not shown) that collects any excess glue, adhesive, and/or fluid that has been redirected away from leading edge device 1014A.

Figure 16:
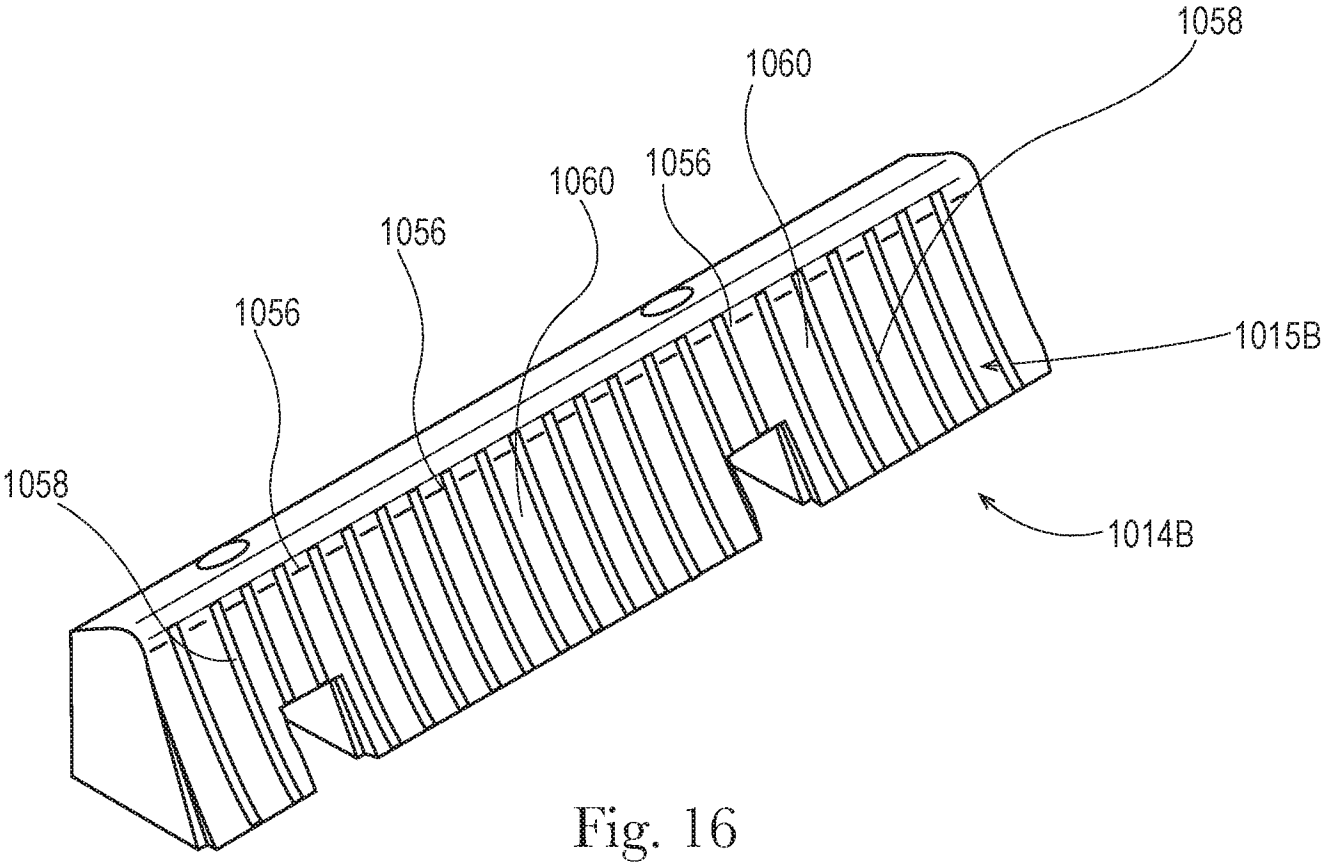
FIG. 16 is a perspective view of yet another exemplary introductory portion for a surface rewinding machine.

Alternatively, as shown in FIG. 16, the raised areas 1058 can each be provided by at least one respective opening 1056. However, one of skill in the art could provide any number of raised areas 1058 with any number of openings 1056 that provide the desired amount of glue, adhesive, and/or other fluid upon a core A that is provided in contacting and pressured engagement thereto. In any regard, a core A presented in contacting engagement with leading edge device 1014B can be facilitated in obtaining rotational motion through the leading edge device 1014B and have glue disposed at a location (pre-determined or otherwise) thereon upon contacting engagement with a respective opening 1056 disposed within any number of the raised areas 1058 disposed upon the surface 1015B.

Further, any number of the recessed areas 1060 can facilitate removal of any excess glue, adhesive, and/or fluid that is not in contacting engagement with a core A. For example, any excess glue, adhesive, and/or fluid that is not in contacting engagement with a core A can overflow into a recess and re-directed away from any downstream manufacturing equipment comprising rewinder 1000. One of skill in the art could even provide glue, adhesive, and/or fluid reclamation equipment and/or systems in fluid engagement with any number of recessed areas 1060. For example, each recessed area can be operative connected to a glue, adhesive, and/or fluid removal channel (not shown) that redirects any excess glue, adhesive, and/or fluid away from leading edge device 1014B. Alternatively, each recessed area can be operative connected to a glue, adhesive, and/or fluid removal reservoir (not shown) that collects any excess glue, adhesive, and/or fluid that has been redirected away from leading edge device 1014B.

Figure 17:
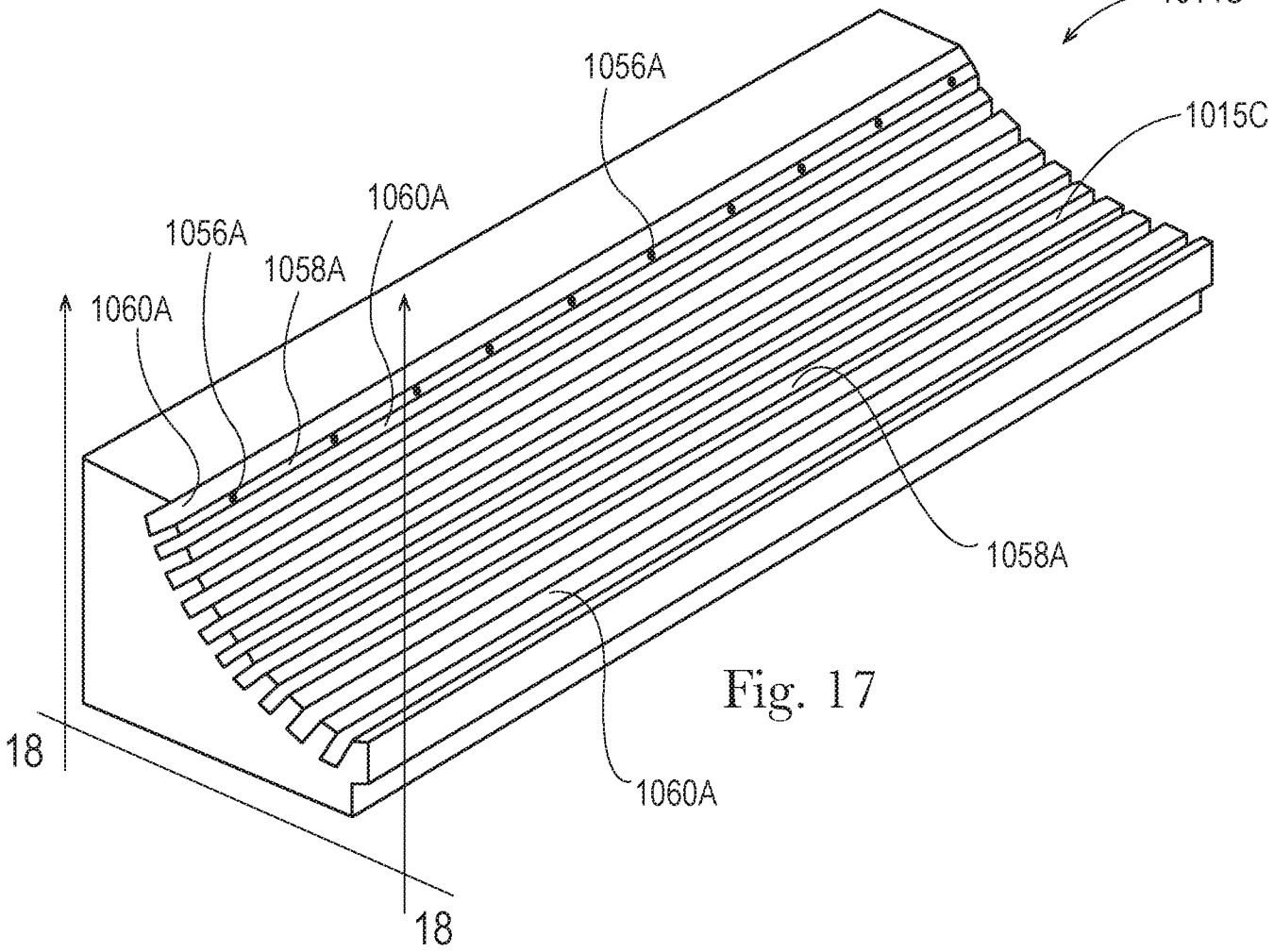
FIG. 17 is a perspective view of still another exemplary introductory portion for a surface rewinding machine.
Figure 18:
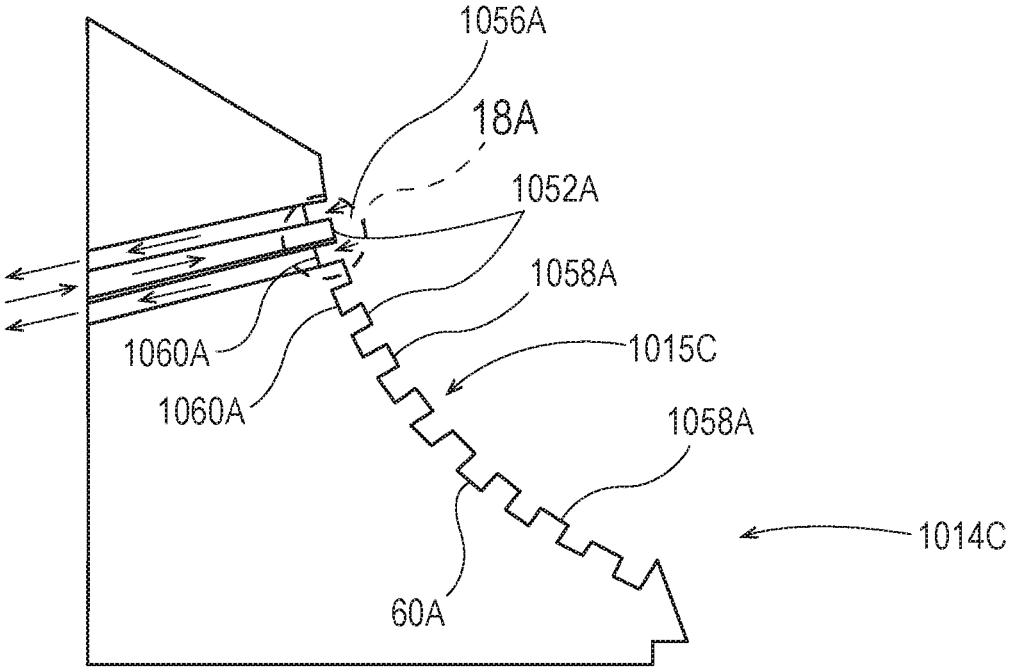
FIG. 18 is a cross-sectional view of the exemplary introductory portion taken at 17-17 of FIG. 16.
Figure 18A:
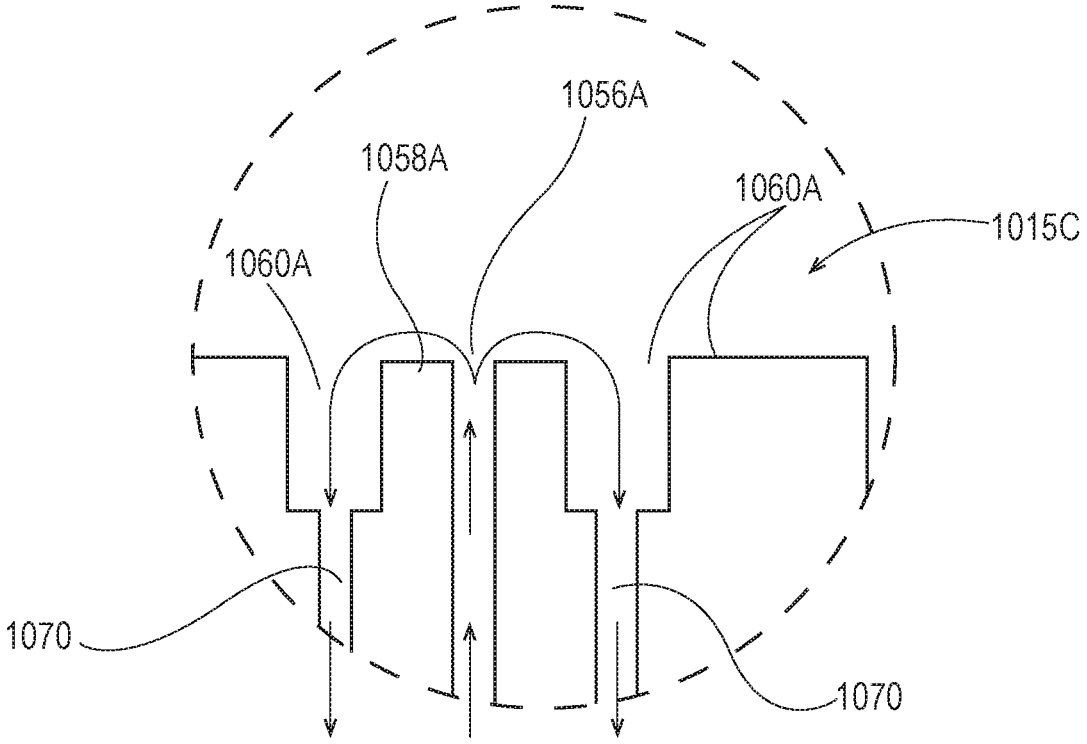
FIG. 18A is a view of the region labeled 18A of FIG. 18.

As shown in FIGS. 17-18 and 18A, the raised areas 1058A of exemplary leading edge device 1014C can be disposed generally parallel or parallel to the longitudinal axis of leading edge device 1014C (generally extending in the CD). As shown, at least one raised area 1058A can be provided by at least one respective opening 1056A or a plurality of openings 1056A. However, one of skill in the art could provide any number of raised areas A that provide the desired amount of glue, adhesive, and/or other fluid upon a core A that is provided in contacting and pressured engagement thereto. In any regard, a core A presented in contacting engagement with leading edge device 1014C can be facilitated in obtaining rotational motion through the leading edge device 1014C and have glue disposed at a location (pre-determined or otherwise) thereon upon contacting engagement with a respective opening 1056A disposed within any number of the raised areas 1058A disposed upon the surface 1015C.

Further, any number of the recessed areas 1060A can facilitate removal of any excess glue, adhesive, and/or fluid that is not in contacting engagement with a core A. For example, any excess glue, adhesive, and/or fluid that is not in contacting engagement with a core A can overflow into a recess and re-directed away from any downstream manufacturing equipment comprising rewinder 1000. One of skill in the art could even provide glue, adhesive, and/or fluid reclamation equipment and/or systems in fluid engagement with any number of recessed areas 1060A. For example, each recessed area can be operatively connected to a glue, adhesive, and/or fluid removal channel 1070 that redirects any excess glue, adhesive, and/or fluid away from the surface 1015C of leading edge device 1014C. Alternatively, each recessed area can be operatively connected to a glue, adhesive, and/or fluid removal reservoir (not shown) with or without the use of fluid a removal channel 1070 that collects any excess glue, adhesive, and/or fluid that has been redirected away from the surface 1015 of leading edge device 1014.

Figure 19:
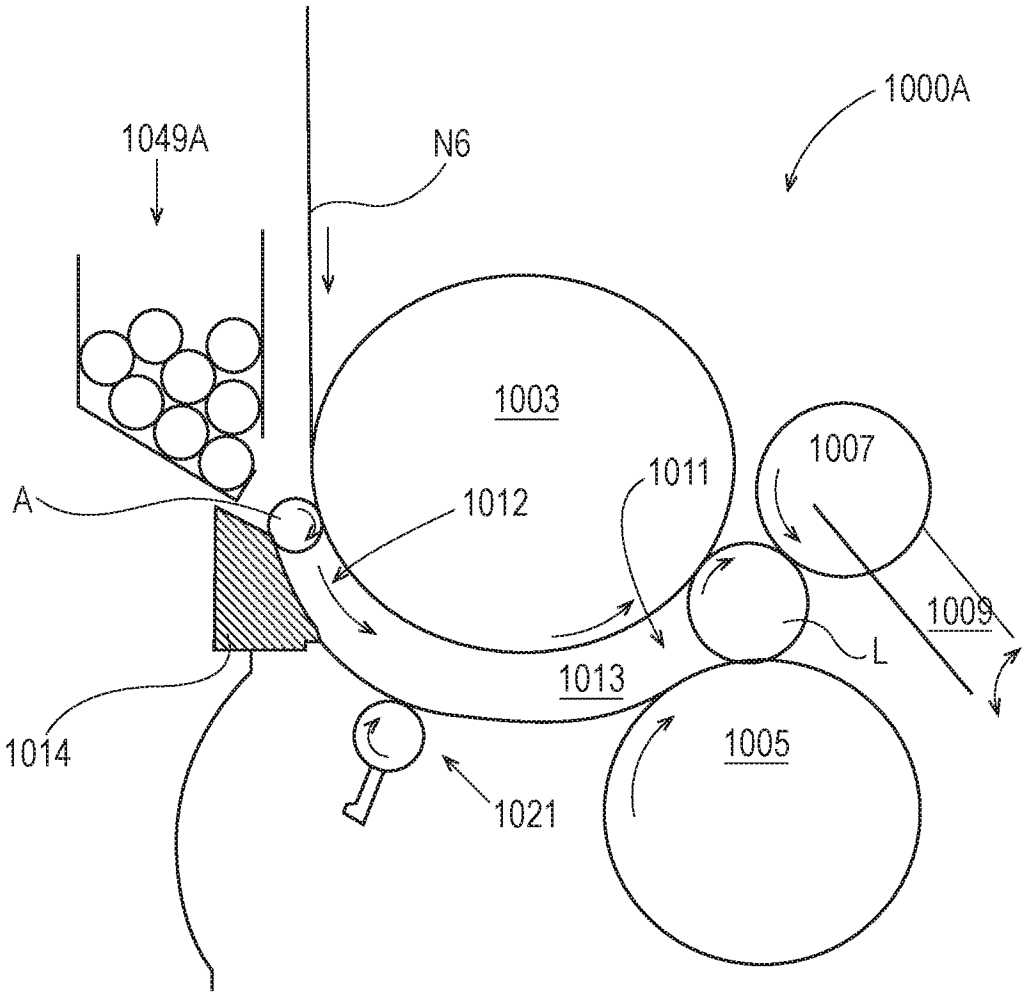
FIG. 19 is a cross-sectional view of another exemplary surface rewinding machine having an exemplary introductory portion and ready to insert a core having no adhesive disposed thereon and stored in a core bin prior to insertion as described by the present disclosure.

As shown in FIG. 19, another exemplary embodiment of a rewinding machine 1000A comprises a first winding roller 1003, a second winding roller 1005, and a third winding roller 1007. A nip 1011 is defined between the two winding rollers 1003 and 1005 for passage of the web material N6, having a speed, v, which can be equal to the surface speed of upper winding roll 1003 and wound about a core A.

The third winding roller 1007 is advantageously carried, for example, by a pair of arms 1009 pivoting with a reciprocating movement according to the double arrow f9. The movement according to the double arrow f9 enables the third winding roller 1007 to move toward or away from the first winding roller 1003 and second winding roller 1005 according to the diameter of the log L during the step of formation inside the winding cradle defined by the three winding rollers 1003, 1005 and 1007.

The exemplary rewinding machine 1000A can be provided with a concave cradle 1041 preferably formed by a series of mutually parallel shaped plates. The various shaped plates all have a concave edge forming a concave surface for rolling of the winding cores A.

Single winding cores A can be stored and individually dropped into the introductory portion 1012 of winding cradle 1013 by a core bin 1049A. Each core A disposed within core bin 1049A can be produced by ancillary equipment suitable for the manufacture of cores A and deposited within core bin 1049A. Core bin 1049A can provide an individual core A to the introductory portion 1012 of winding cradle 1013 by means of an articulable, or rotary, gate that opens and closes an opening allowing egress of a core A from core bin 1049A. Alternatively, a plurality of retractable pins can obfuscate an outlet opening of core bin 1049A to prevent expulsion of a core A from core bin 1049A. When a core A is required by rewinder 1000A, the retractable pins preventing core ejection from core bin 1049A can be retracted thereby allowing the expulsion of a core A from core bin 1049A into the introductory portion 1012 of winding cradle 1013.

Without desiring to be bound by theory, it is believed that providing a core bin 1049A that contains cores A and effectively deposits individual cores A to the introductory portion 1012 of winding cradle 1013 can eliminate the need for additional equipment that provides translation of cores A from a first position to the introductory portion 1012 of winding cradle 1013. This can provide a more reliable and consistent insertion of a winding core A into the introductory portion 1012 of winding cradle 1013.

Moving member 1021 can be used to sever the web material N6, but winding starts on the central core A and the member 1021 does not perform any function in relation to this action, except for an optional effect of accompanying the leading edge toward the new winding core A that is inserted into the channel formed between the winding roller 1003 and the cradle 1041 upstream (with respect to the direction of feed of the web material N6) of the moving member 1021. The moving member passes from an idle position to an operating position by pivoting about the rotation axis 1021C. Pivoting can be controlled by a piston-cylinder actuator. Moving member 1021 can be provided with a reciprocating oscillatory or rotary movement and rotates in clockwise direction to come into contact with the web material N6 and pinch it against the cylindrical surface of the winding roller 1003 and perform severing of the web material N6.

Figure 20:
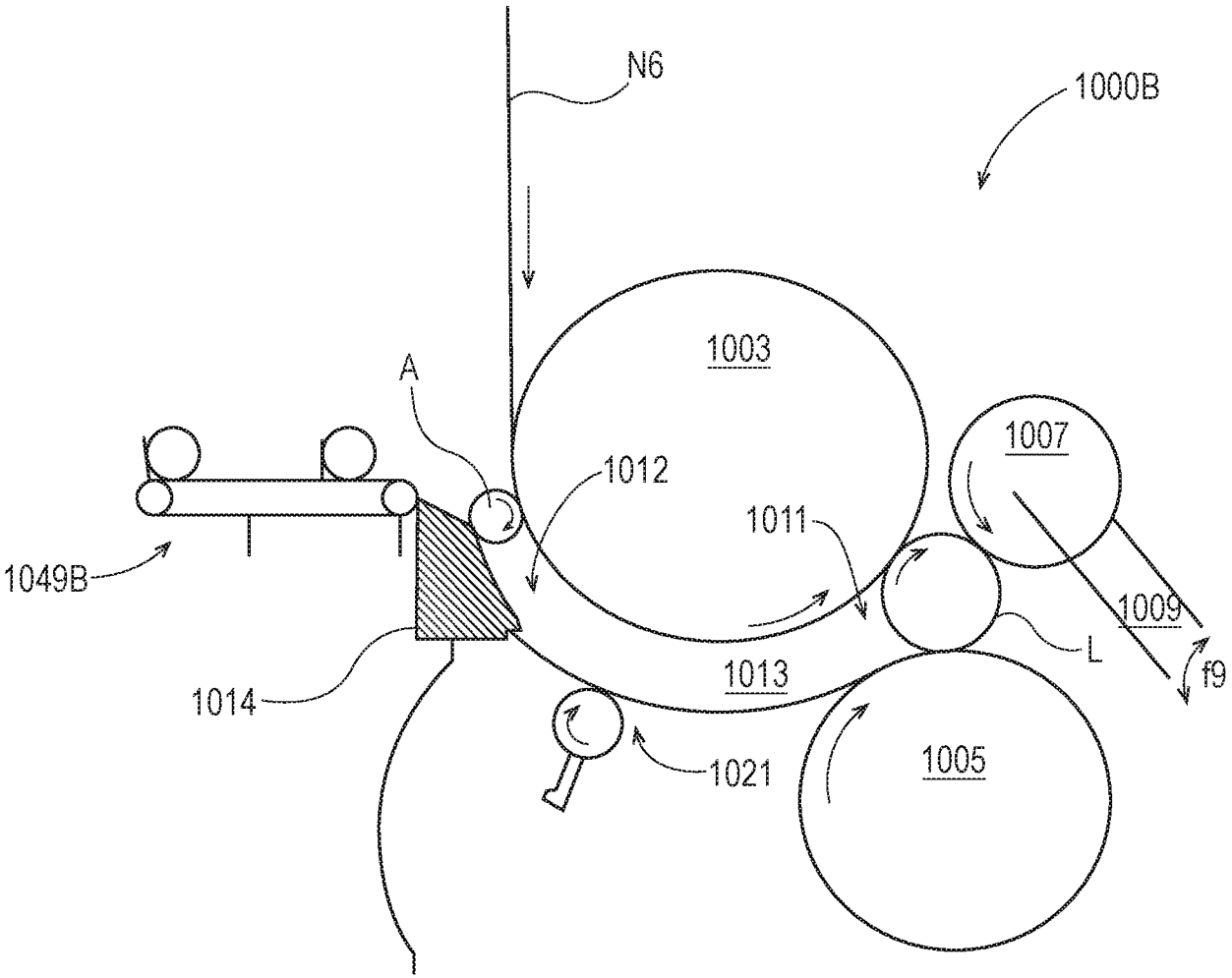
FIG. 20 is a cross-sectional view of an exemplary surface rewinding machine having an exemplary introductory portion and conveying a core having no adhesive disposed thereon thereto as described by the present disclosure.

As shown in FIG. 20, yet another exemplary embodiment of a rewinding machine 1000B comprises a first winding roller 1003, a second winding roller 1005, and a third winding roller 1007. A nip 1011 is defined between the two winding rollers 1003 and 1005 for passage of the web material N6. The third winding roller 1007 is carried by a pair of arms 1009 pivoting with a reciprocating movement according to the double arrow f9. The third winding roller 1007 moves toward or away from the first winding roller 1003 and second winding roller 1005 along the double arrow f9 according to the diameter of the log L during the step of formation inside the winding cradle defined by the three winding rollers 1003, 1005 and 1007.

The exemplary rewinding machine 1000B can be provided with a concave cradle 1041 preferably formed by a series of mutually parallel shaped plates. The various shaped plates all have a concave edge forming a concave surface for rolling of the winding cores A.

Single winding cores A can be conveyed and individually dropped into introductory portion 1012 of winding cradle 1013 by a conveyor 1049B. Each core A disposed upon conveyor 1049B can be produced by ancillary equipment suitable for the manufacture of cores A and individually deposited onto conveyor 1049B. Conveyor 1049B can provide an individual core A to the introductory portion of winding cradle 1013 by means of a pusher or other conveyance assistance mechanism disposed upon and/or integral with conveyor 1049B that assists in conveying and effectively pushes a core A into introductory portion 1012.

Moving member 1021 can be used to sever the web material N6, but winding starts on the central core A and the member 1021 does not perform any function in relation to this action, except for an optional effect of accompanying the leading edge toward the new winding core A that is inserted into the channel formed between the winding roller 1003 and the cradle 1041 upstream (with respect to the direction of feed of the web material N6) of the moving member 1021. The moving member passes from an idle position to an operating position by pivoting about the rotation axis 1021C. Pivoting can be controlled by a piston-cylinder actuator. Moving member 1021 can be provided with a reciprocating oscillatory or rotary movement and rotates in clockwise direction to come into contact with the web material N6 and pinch it against the cylindrical surface of the winding roller 1003 and perform severing of the web material N6.

Figure 21:
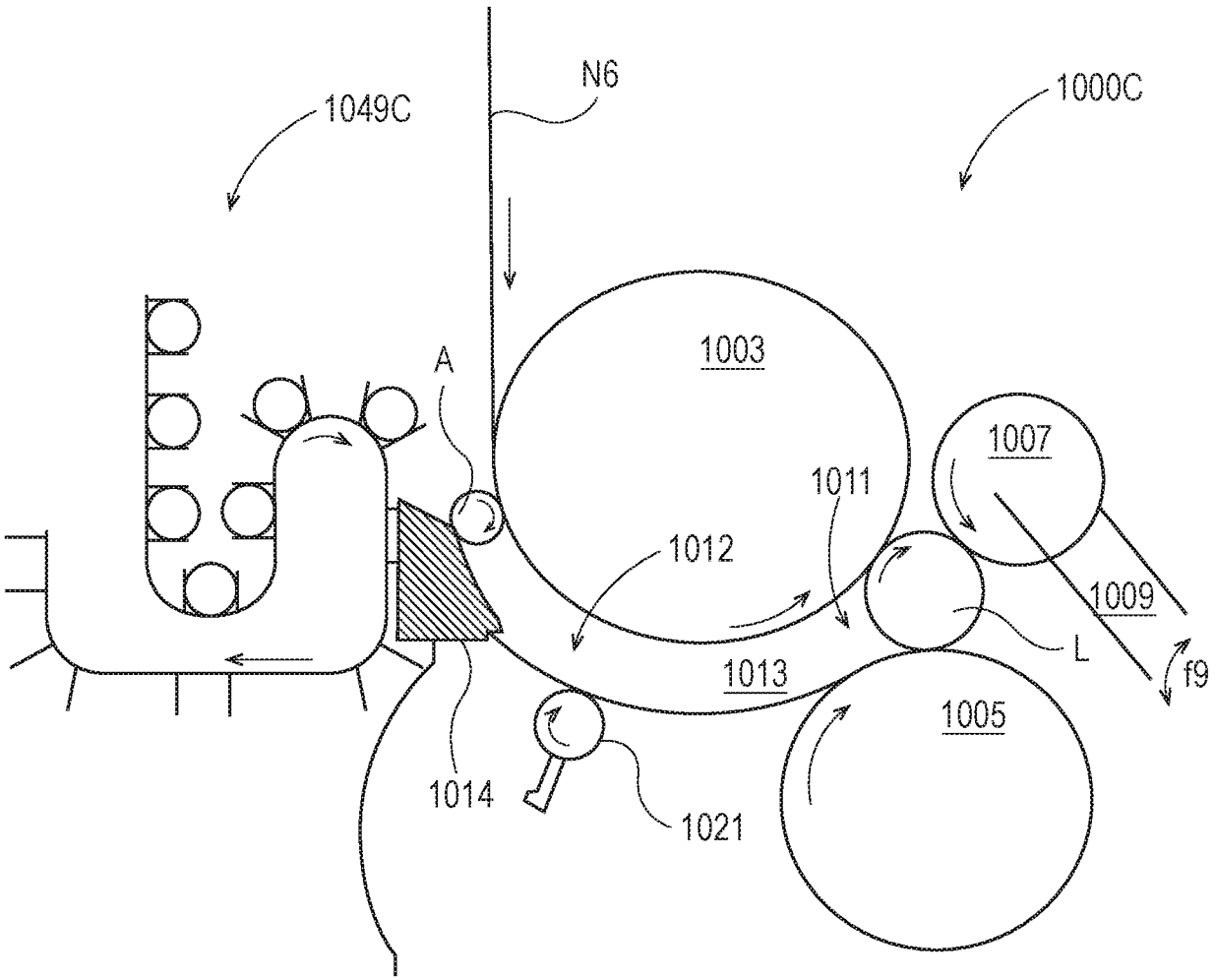
FIG. 21 is a cross-sectional view of an exemplary surface rewinding machine having an exemplary introductory portion and conveying a core having no adhesive disposed thereon from an accumulator thereto as described by the present disclosure; and, FIG. 22 is an example of a convolutely wound web material wound about a core using the exemplary surface winding machines of the present disclosure and having no core glue applied to the core or alternatively the web material being convolutely wound about a core having a first COF during winding and a second COF after winding.

As shown in FIG. 21, yet another exemplary embodiment of a rewinding machine 1000C comprises a first winding roller 1003, a second winding roller 1005, and a third winding roller 1007. A nip 1011 is defined between the two winding rollers 1003 and 1005 for passage of the web material N6 to be wound about a core A. The third winding roller 1007 is carried by a pair of arms 1009 pivoting with a reciprocating movement according to the double arrow f9. The third winding roller 1007 moves toward or away from the first winding roller 1003 and second winding roller 1005 along the double arrow f9 according to the diameter of the log L during the step of formation inside the winding cradle defined by the three winding rollers 1003, 1005 and 1007.

The exemplary rewinding machine 1000C can be provided with a concave cradle 1041 formed by a series of mutually parallel shaped plates. The various shaped plates all have a concave edge forming a concave surface for rolling of the winding cores A. Single winding cores A can be conveyed and individually dropped into introductory portion 1012 of winding cradle 1013 by an accumulator 1049C. Each core A disposed upon accumulator 1049C can be produced by ancillary equipment suitable for the manufacture of cores A and individually deposited onto accumulator 1049C. Accumulator 1049C can provide an individual core A to the introductory portion of winding cradle 1013 by means of a pusher or other conveyance assistance mechanism disposed upon and/or integral with accumulator 1049C that assists in conveying and effectively pushes a core A into introductory portion 1012. The use of an accumulator 1049C can facilitate the continued production of cores A and storage thereof when rewinding machine 1000C is not operational. Such a circumstance can arise during production due to a mechanical breakage issue, a web material N6 break, and the like. Further, the use of an accumulator 1049C can facilitate the continued production of cores A and storage thereof when rewinding machine 1000C is not operational for periodic maintenance.

Moving member 1021 can be used to sever the web material N6, but winding starts on the central core A and the member 1021 does not perform any function in relation to this action, except for an optional effect of accompanying the leading edge toward the new winding core A that is inserted into the channel formed between the winding roller 1003 and the cradle 1041 upstream (with respect to the direction of feed of the web material N6) of the moving member 1021. The moving member passes from an idle position to an operating position by pivoting about the rotation axis 1021C. Pivoting can be controlled by a piston-cylinder actuator. Moving member 1021 can be provided with a reciprocating oscillatory or rotary movement and rotates in clockwise direction to come into contact with the web material N6 and pinch it against the cylindrical surface of the winding roller 1003 and perform severing of the web material N6.

The described rewinders having the described introductory portion of the present disclosure can provide the aforementioned complete control of the core during all stages of the winding process. This is because the described rewinders having the described introductory portion can overcome the significant challenges presented by rewinders that apply adhesive to the core prior to insertion into the winding cradle of the prior art rewinders as well as the prior art rewinders that provide a leading edge device having a generally smooth and polished finished surface.

As mentioned supra, the described leading edge device reduces, or can even eliminate, sliding of a winding core disposed within the introductory portion of a winding cradle as well as misregistration of the glue laden core relative to the web material within the introductory portion of the winding cradle. In short, the rewinder described herein can reduce, or even eliminate, mal-formed final convolutely wound products (e.g., consumer undesirable and unattractively wound products). For example, the rewinder described herein can reduce the occurrence of the web attachment point occurring at a point removed backwards from the region near the perforation (e.g., behind the perforation). This effectively reduces any excess leading web material 'folding-back' upon the core and overlapping the region of actual attachment of the web material to the core.

Additionally, the rewinder described herein can reduce the occurrence of the web attachment point occurring at a point removed forwards from the region near the perforation (e.g., ahead of the perforation) and causing the web material to fail to attach to the core. In this regard, the rewinder described herein can reduce, or even eliminate the deposition of the adhesive disposed upon the core contacting and depositing upon the manufacturing equipment resulting in process shut-downs to remove adhesive from the surfaces of the rewinder such as first winding roller, second winding roller, third winding roller, concave cradle, winding cradle, and/or leading edge device.

In short, the described rewinder can more accurately target contacting the adhesive disposed upon the core with the web material in contact with the UWR at a predetermined location. In other words, the adhesive disposed upon the core by the herein described rewinder can contact a targeted location on the web material that is immediately adjacent a perforation. This improved correlation and placement of adhesive upon a core can prevent the drawbacks observed by current surface winding equipment that meets current manufacturing financial and processing targets. This provides a closer association of the position upon the core where the adhesive is disposed thereupon with the web material that is intended to be contacted thereto.

Additionally, one of skill in the art will also recognize that the rewinder having the leading edge device herein can effectively eliminate the need for the conventional application, process, and use of disposing an adhesive upon a core in order to attach a web material thereto. The described rewinder can completely eliminate the need to use adhesives and reduce the drawbacks associated with the use of adhesives in rewinding operations.

Figure 22:
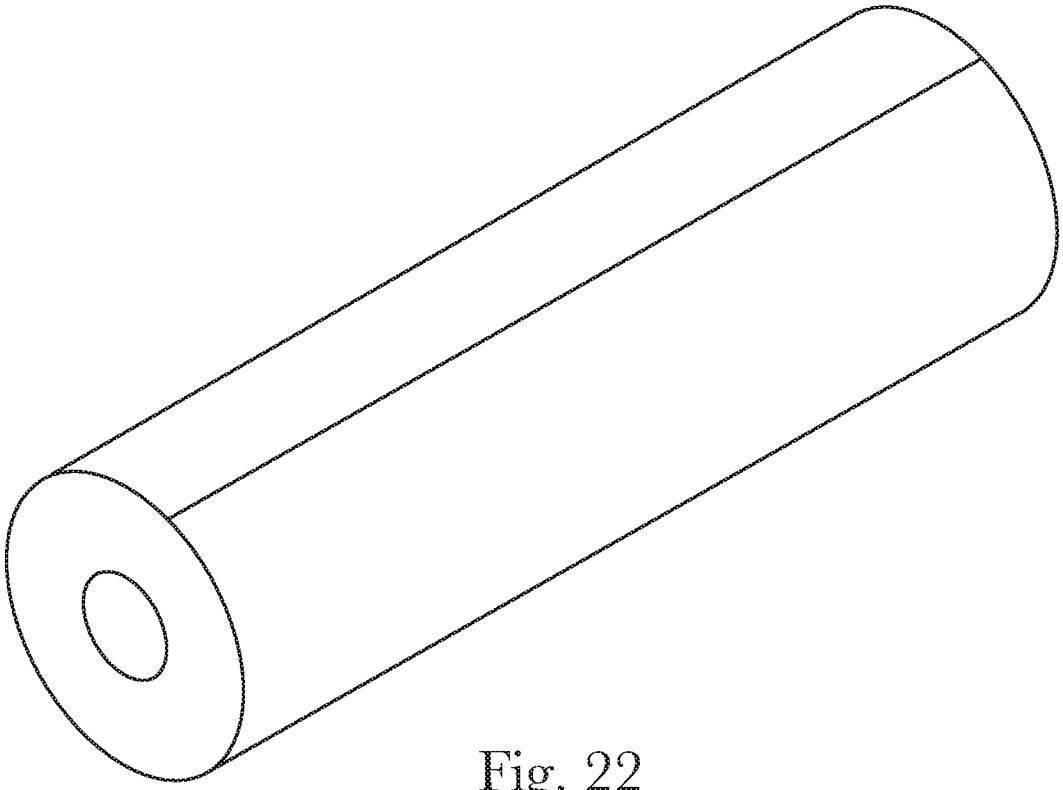

As shown in FIG. 22, for example, since the winding core is motion constrained within the introductory portion or the rewinder, and is provided in contacting engagement with the leading edge device and the web material disposed upon the surface of the UWR, one of skill in the art will understand that it may be beneficial to only modify the coefficient of friction (COF) of the surface of the winding core temporarily in order to secure convolute winding of the web material about the winding core. In other words, the surface of the winding core can be provided with a first COF during the rewinding operation that evolves into a second COF after the rewinding operation. Since the consumer of the final convolutely wound product seeks to use all web material disposed about the winding core in use, there is an advantage to not having the final portion of web material actually contacting the core be adhesively attached thereto. Stated differently, the winding core can be provided with a first COF during winding and have a second COF at some point in time after winding that is different (e.g., lower, less than, and/or different) than the first COF. By way of example, water can be applied to the surface of the winding core. Water has been found to increase the COF of the surface of the winding core when applied. After web material has been wound about the winding core, water was found to effectively evaporate from the surface of the winding core thereby decreasing the COF of the surface of the winding core. The resulting wound web material can then be provided in contacting, but not adhesive, engagement with the winding core.

Additionally, because the leading edge device of the introductory portion of the rewinder, described supra, can apply a fluid to the winding core while the winding core is disposed between the leading edge device and the UWR, the relative size, shape and position of the fluid (e.g., adhesive or other fluid) disposed upon the winding core and position of the pressure-sensitive valves and/or opening disposed within the surface of the exemplary leading edge device can be positioned as desired by the manufacturing process. In any event, a fluid may be emitted, extruded, printed, or otherwise applied, to the winding core in a non-uniform pattern. A non-uniform pattern may include for example, a higher concentration of bonding material positioned towards the outer edges of the winding core. A non-uniform pattern may include a plurality of discrete, disconnected application sites disposed upon the surface of the winding core.

In some embodiments, a non-uniform pattern can be wavy, curved, or curvilinear pattern such that there is generally a contiguous application in the cross direction of the winding core. Nevertheless, the overall pattern or arrangement of the fluid upon the winding core can be non-uniform in any of the CD, the MD, or both. A non-uniform pattern may be generally optimized to utilize sufficient bonding material to maintain attachment of the tail to the winding core during manufacturing, while also providing a consumer with ease of detachment. In this regard, a greater amount of bonding material or application sites may be located towards the outsides edges of the winding core, which are more likely to become unattached during manufacturing, as compared to the center region of the winding core.

Additionally, it would be possible for one of skill in the art to provide a core material that has a web material contacting surface having a COF that is higher than a standard winding core having a smooth surface such as is currently used by manufacturers of convolutely wound web materials. Such a core, or core material, could be provided with a surface having a plurality of rugosities applied thereto. Alternatively, one of skill in the art could provide a core, or core material, that has an abrasive substance applied thereto. Such a core construction could provide for a core having a high COF sufficient for starting and supporting a web material to be convolutely wound thereabout but not facilitate adhesive attachment of the web material to the surface of the core. Such attachment would be contacting, non-adhesive, engagement.

EXAMPLES a. A surface winder for winding a web material about a core having a radius, R, to obtain a log of convolutely wound web material, the surface winder comprising a core inserter for inserting said core into an introductory portion of a winding cradle, said introductory portion being defined by an upper winding roller, supplied from above with said web material directed towards said introductory portion at a velocity, v, and at a bottom by a concave cradle having a leading edge device, said concave cradle being associated downstream with a lower winding roller, said surface winder comprising a third oscillating roller arranged above said lower winding roller, said upper winding roller, said lower winding roller, and said third oscillating roller each having a respective axes parallel to each other and perpendicular to the feeding direction of said web material and cooperating with each other downstream of said introductory portion to form said winding cradle in order to convolutely wind said web material about said core to obtain said log, said leading edge device comprising a surface, said leading edge device having at least one channel disposed therein, said at least one channel having a single entry point and a single exit point and extending from a position external to said leading edge device and a first location disposed upon said surface, said first location disposed upon said surface being capable of receiving a fluid from said at least one channel, said fluid being fluidically displaced onto said core from said at least one channel when said core is in contacting engagement with said first location disposed upon said surface.

b. The surface winder of a. wherein said surface further comprises a pressure-sensitive valve disposed thereon, said pressure-sensitive valve being in fluid communication with said at least one channel at said first location disposed upon said surface, said pressure-sensitive valve providing fluid communication of said first fluid from said channel to said core when said core is in contacting engagement therewith.

c. The surface winder of any of a. through b. wherein said surface further comprises an opening disposed thereon at said first location disposed upon said surface, said opening being in fluid communication with said at least one channel at said first location disposed upon said surface, said opening providing fluid communication of said first fluid from said channel to said core when said core is in contacting engagement therewith.

d. The surface winder of any of a. through c. wherein said surface causes said core to rotate at an angular velocity, $\omega$, wherein $v=R\omega$.

e. The surface winder of any of a. through d. wherein said surface further comprises a texture comprising a plurality of protuberances disposed upon said surface, said core contacting said protuberances when disposed within said introductory portion.

f. The surface winder of e. wherein each protuberance of said plurality of protuberances is provided with a geometry, said geometry of each of said protuberances reducing slippage between said core and said surface of said leading edge device.

g. The surface winder of any of a. through f. wherein said surface comprises at least one recess disposed therein.

h. The surface winder of g. wherein said recess is operatively connected to a second at least one channel, said second at least one channel having a single entry point and a single exit point and extending from a position external to said leading edge device and said recess, said second at least one channel being capable of receiving at least a portion of said first fluid from said recess, said at least a portion of said first fluid being fluidically displaceable through said second at least one channel to a position external to said leading edge device from said recess.

i. The surface winder of any of a. through h. wherein said surface further comprises a raised area, said at least one channel extending from a position external to said leading edge device and said raised area.

j. The surface winder of any of a. through i. wherein said surface further comprises at least a second channel disposed therein, said second channel having a single entry point and a single exit point and extending from a position external to said leading edge device and a second location disposed upon said surface, said surface being capable of receiving said fluid from said second channel at said second location disposed upon said surface, said fluid being fluidically displaced onto said core from said second channel when said core is in contacting engagement with said surface.

k. The surface winder of any of a. through j. wherein said surface winder rotates said core about a longitudinal axis within said introductory portion such that said core contacts said web material and said surface winder causes said web material to adhesively bond said web material to said core after said fluid is fluidically displaced onto said core from said at least one channel when said core is in contacting engagement with said first location disposed upon said surface.

l. The surface winder of k. wherein said surface winder rotates said core about said longitudinal axis after said web material is adhesively bonded onto said core to convolutely wind said web material about said core.

m. The surface winder of l. wherein said core inserter translates said core form a first position external to said surface winder to said introductory portion.

n. A surface winder for winding a web material around a core having a radius, R, to obtain a log of convolutely wound web material, the surface winder comprising a core inserter for inserting said core having a plurality of rugosities disposed upon a surface thereof into an introductory portion of a winding cradle, said introductory portion being defined by an upper winding roller, supplied from above with said web material directed towards said introductory portion at a velocity, v, and at a bottom by a concave cradle having a leading edge device operatively attached thereto, said concave cradle being associated downstream with a lower winding roller, said surface winder comprising a third oscillating roller arranged above said lower winding roller, said upper winding roller, said lower winding roller, and said third oscillating roller each having a respective axes parallel to each other and perpendicular to the feeding direction of said web material and cooperating with each other downstream of said introductory portion to form said winding cradle in order to convolutely wind said web material about said core to obtain said log, said leading edge device comprising a surface having a texture disposed thereon, said texture reducing slippage of said core when said core is disposed within said introductory portion, said rugosities disposed upon said core facilitating attachment of said web material to said core.

o. The surface winder of n. wherein said surface causes said core to rotate at an angular velocity, $\omega$, wherein $v=R\omega$.

p. The surface winder of any of n. through o. wherein said texture comprises a plurality of protuberances disposed upon said surface of said leading edge device, said core contacting said protuberances when disposed within said introductory portion.

q. The surface winder of any of n. through p. wherein each protuberance of said plurality of protuberances are provided with a geometry, said geometry of each of said protuberances reducing slippage between said core and said surface of said leading edge device.

r. The surface winder of any of n. through p. wherein said surface winder rotates said core about said longitudinal axis after said web material is attached to said rugosities to convolutely wind said web material about said core.

s. The surface winder of any of n. through r. wherein said core inserter contains a plurality of said cores.

t. The surface winder of any of n. through s. wherein said core inserter translates said core form a first position external to said surface winder to said introductory portion.

u. A convolutely wound web material comprising a core having said web material wound convolutely about a surface thereof, said surface having a first coefficient of friction when said web material is convolutely wound thereabout and a second coefficient of friction when said web material convolutely wound thereabout is unwound from said surface, said second coefficient of friction being less than said first coefficient of friction.

v. The convolutely wound web material of u. wherein said surface of said core is smooth.

w. The convolutely wound web material of any of u. through v. wherein said first coefficient of friction evolves to said second coefficient of friction after said web material is wound about said core.

x. The convolutely wound web material of any of u. through w. wherein said web material is not adhesively attached to said surface of said core.

y. The convolutely wound web material of any of u. through x. wherein a fluid is applied to said surface of said core, said fluid providing said first coefficient of friction.

z. The convolutely wound web material of any of u. through y. wherein said fluid is water.

aa. The convolutely wound web material of y. wherein said fluid is applied to said surface of said core in a pattern.

bb. The convolutely wound web material of aa. wherein said pattern is non-uniform over said surface of said core.

cc. The convolutely wound web material of aa. wherein said pattern comprises a plurality of discrete applications of fluid to said surface of said core.

dd. The convolutely wound web material of aa. wherein said core comprises a machine direction and a cross machine direction, said pattern is applied in both said machine- and cross-machine directions.

ee. The convolutely wound web material of aa. wherein said core has a proximal end and a distal end, said fluid being applied to said surface of said core proximate to said proximal and distal ends of said core.

ff. A convolutely wound web material comprising a core having said web material wound convolutely about a surface thereof, said surface having a fluid disposed thereon, said fluid providing said surface of said core with a first coefficient of friction when said web material is convolutely wound thereabout and a second coefficient of friction when said web material convolutely wound thereabout is unwound from said surface, said second coefficient of friction being less than said first coefficient of friction.

gg. The convolutely wound web material of ff. wherein said surface of said core is smooth.

hh. The convolutely wound web material of any of ff. through gg. wherein said first coefficient of friction evolves to said second coefficient of friction after said web material is wound about said core.

ii. The convolutely wound web material of any of ff. through hh. wherein said web material is not adhesively attached to said surface of said core.

jj. The convolutely wound web material of any of ff. through ii. wherein said fluid is water.

kk. The convolutely wound web material of any of ff. through jj. wherein said fluid is applied to said surface of said core in a pattern.

ll. The convolutely wound web material of kk. wherein said pattern is non-uniform over said surface of said core.

mm. The convolutely wound web material of kk. wherein said pattern comprises a plurality of discrete applications of fluid to said surface of said core.

nn. The convolutely wound web material of kk. wherein said core comprises a machine direction and a cross machine direction, said pattern is applied in both said machine- and cross-machine directions.

oo. The convolutely wound web material of any of ff. though nn. wherein said core has a proximal end and a distal end, said fluid being applied to said surface of said core proximate to said proximal and distal ends of said core.

pp. A convolutely wound web material comprising a core having said web material wound convolutely about a surface thereof, said surface having a plurality of rugosities disposed thereon, said rugosities providing contacting engagement of said surface of said core with said web material as said web material is convolutely wound thereabout.

Any dimensions and/or values disclosed herein are not to be understood as being strictly limited to the exact dimensions and/or numerical values recited. Instead, unless otherwise specified, each such dimension and/or value is intended to mean both the recited dimension and/or value and a functionally equivalent range surrounding that dimension or value. For example, a dimension disclosed as "40 mm" is intended to mean "about 40 mm."

All documents cited in the Detailed Description of the Invention are, in relevant part, incorporated herein by reference; the citation of any document is not to be construed as an admission that it is prior art with respect to the present invention. To the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A surface winder for winding a web material about a core having a radius, R, to obtain a log of convolutely wound web material, the surface winder comprising a core inserter for inserting said core into an introductory portion of a winding cradle, said introductory portion being defined by an upper winding roller, supplied from above with said web material directed towards said introductory portion at a velocity, v, and at a bottom by a concave cradle having a leading edge device, said concave cradle being associated downstream with a lower winding roller, said surface winder comprising a third oscillating roller arranged above said lower winding roller, said upper winding roller, said lower winding roller, and said third oscillating roller each having a respective axes parallel to each other and perpendicular to the feeding direction of said web material and cooperating with each other downstream of said introductory portion to form said winding cradle in order to convolutely wind said web material about said core to obtain said log, said leading edge device comprising a surface, said leading edge device having at least one channel disposed therein, said at least one channel having a single entry point and a single exit point and extending from a position external to said leading edge device and a first location disposed upon said surface, said first location disposed upon said surface being capable of receiving a fluid from said at least one channel, said fluid being fluidically displaced onto said core from said at least one channel when said core is in contacting engagement with said first location disposed upon said surface.

2. The surface winder of claim 1 wherein said surface further comprises a pressure-sensitive valve disposed thereon, said pressure-sensitive valve being in fluid communication with said at least one channel at said first location disposed upon said surface, said pressure-sensitive valve providing fluid communication of said first fluid from said channel to said core when said core is in contacting engagement therewith.

3. The surface winder of claim 1 wherein said surface further comprises an opening disposed thereon at said first location disposed upon said surface, said opening being in fluid communication with said at least one channel at said first location disposed upon said surface, said opening providing fluid communication of said first fluid from said channel to said core when said core is in contacting engagement therewith.

4. The surface winder of claim 1 wherein said surface causes said core to rotate at an angular velocity, $\omega$, wherein $v=R\omega$.

5. The surface winder of claim 1 wherein said surface further comprises a texture comprising a plurality of protuberances disposed upon said surface, said core contacting said protuberances when disposed within said introductory portion.

6. The surface winder of claim 5 wherein each protuberance of said plurality of protuberances is provided with a geometry, said geometry of each of said protuberances reducing slippage between said core and said surface of said leading edge device.

7. The surface winder of claim 1 wherein said surface comprises at least one recess disposed therein.

8. The surface winder of claim 7 wherein said recess is operatively connected to a second at least one channel, said second at least one channel having a single entry point and a single exit point and extending from a position external to said leading edge device and said recess, said second at least one channel being capable of receiving at least a portion of said first fluid from said recess, said at least a portion of said first fluid being fluidically displaceable through said second at least one channel to a position external to said leading edge device from said recess.

9. The surface winder of claim 1 wherein said surface further comprises a raised area, said at least one channel extending from a position external to said leading edge device and said raised area.

10. The surface winder of claim 1 wherein said surface further comprises at least a second channel disposed therein, said second channel having a single entry point and a single exit point and extending from a position external to said leading edge device and a second location disposed upon said surface, said surface being capable of receiving said fluid from said second channel at said second location disposed upon said surface, said fluid being fluidically displaced onto said core from said second channel when said core is in contacting engagement with said surface.

11. The surface winder of claim 1 wherein said surface winder rotates said core about a longitudinal axis within said introductory portion such that said core contacts said web material and said surface winder causes said web material to adhesively bond said web material to said core after said fluid is fluidically displaced onto said core from said at least one channel when said core is in contacting engagement with said first location disposed upon said surface.

12. The surface winder of claim 11 wherein said surface winder rotates said core about said longitudinal axis after said web material is adhesively bonded onto said core to convolutely wind said web material about said core.

13. The surface winder of claim 1 wherein said core inserter translates said core form a first position external to said surface winder to said introductory portion.

14. A surface winder for winding a web material around a core having a radius, R, to obtain a log of convolutely wound web material, the surface winder comprising a core inserter for inserting said core having a plurality of rugosities disposed upon a surface thereof into an introductory portion of a winding cradle, said introductory portion being defined by an upper winding roller, supplied from above with said web material directed towards said introductory portion at a velocity, $v$, and at a bottom by a concave cradle having a leading edge device operatively attached thereto, said concave cradle being associated downstream with a lower winding roller, said surface winder comprising a third oscillating roller arranged above said lower winding roller, said upper winding roller, said lower winding roller, and said third oscillating roller each having a respective axes parallel to each other and perpendicular to the feeding direction of said web material and cooperating with each other downstream of said introductory portion to form said winding cradle in order to convolutely wind said web material about said core to obtain said log, said leading edge device comprising a surface having a texture disposed thereon, said texture reducing slippage of said core when said core is disposed within said introductory portion, said rugosities disposed upon said core facilitating attachment of said web material to said core.

15. The surface winder of claim 14 wherein said surface causes said core to rotate at an angular velocity, $\omega$, wherein $v=R\omega$.

16. The surface winder of claim 14 wherein said texture comprises a plurality of protuberances disposed upon said surface of said leading edge device, said core contacting said protuberances when disposed within said introductory portion.

17. The surface winder of claim 16 wherein each protuberance of said plurality of protuberances are provided with a geometry, said geometry of each of said protuberances reducing slippage between said core and said surface of said leading edge device.

18. The surface winder of claim 14 wherein said surface winder rotates said core about said longitudinal axis after said web material is attached to said rugosities to convolutely wind said web material about said core.

19. The surface winder of claim 14 wherein said core inserter contains a plurality of said cores.

20. The surface winder of claim 14 wherein said core inserter translates said core form a first position external to said surface winder to said introductory portion.

* * * * *